US005950859A

United States Patent [19]

Nguyen et al.

[11] Patent Number: 5,950,859

[45] Date of Patent: Sep. 14, 1999

[54] CONTAINER WITH SEALING MEMBER

[75] Inventors: Tuan A. Nguyen; Howard Curtis Chasteen, both of Golden; Michael Duane Richardson, Louisville, all of Colo.

[73] Assignee: Ball Corporation, Broomfield, Colo.

[21] Appl. No.: 08/824,244

[22] Filed: Mar. 25, 1997

[51] Int. Cl.[6] ..... B65D 17/40; B65D 17/48; B65D 41/40; B65D 53/00

[52] U.S. Cl. ..... 220/276; 220/280; 220/310.1; 220/378; 220/849

[58] Field of Search ..... 220/276, 280, 220/310.1, 378, 260, 267, 270, 277, 279, 806, 619, 620, 366.1, 309.1, 309.2, 337, 342, 843, 845, 849

[56] References Cited

U.S. PATENT DOCUMENTS

| | | |
|---|---|---|
| Re. 8,126 | 3/1878 | Wilson, Jr. . |
| 205,677 | 7/1878 | Porter . |
| 1,622,236 | 3/1927 | Gunter . |
| 1,734,378 | 11/1929 | Hildebrandt . |
| 1,860,201 | 5/1932 | Punte . |
| 2,277,066 | 3/1942 | Bogner . |
| 2,382,378 | 8/1945 | Bloedorn . |
| 2,535,839 | 12/1950 | Coyle et al. . |
| 2,843,650 | 7/1958 | Jacquier . |
| 2,940,633 | 6/1960 | Thacker . |
| 3,223,063 | 12/1965 | Payton . |
| 3,224,627 | 12/1965 | Dielmann et al. . |
| 3,228,552 | 1/1966 | Rutledge . |
| 3,460,709 | 8/1969 | Bieder et al. . |
| 3,720,347 | 3/1973 | Stoffregen . |
| 3,721,365 | 3/1973 | Saunders . |
| 3,930,593 | 1/1976 | Ragettli . |
| 3,942,675 | 3/1976 | Hasegawa . |
| 4,301,939 | 11/1981 | Pupp . |
| 4,427,128 | 1/1984 | Heyn . |
| 4,545,494 | 10/1985 | Sawicki . |
| 4,660,735 | 4/1987 | Peschardt et al. . |
| 4,934,554 | 6/1990 | Edwards . |
| 4,951,836 | 8/1990 | Yoshimura et al. . |
| 5,042,680 | 8/1991 | Argudo et al. . |
| 5,115,934 | 5/1992 | Nelson . |
| 5,178,297 | 1/1993 | Harold . |
| 5,271,517 | 12/1993 | Bowers . |

FOREIGN PATENT DOCUMENTS

| | | |
|---|---|---|
| 638233 | 3/1962 | Canada . |
| 103621 | 3/1964 | Norway . |
| 266019 | 4/1950 | Switzerland . |
| 616596 | 1/1949 | United Kingdom . |
| 733833 | 7/1955 | United Kingdom . |

*Primary Examiner*—Stephen K. Cronin
*Assistant Examiner*—Nathan Newhouse
*Attorney, Agent, or Firm*—Sheridan Ross P.C.

[57] ABSTRACT

Various embodiments of a sealing member disposed between a container body and an endpiece attached thereto are disclosed, as well as a method for disposing a sealing member between an endpiece and a container body. In one embodiment, a sealing member is disposed within a space between a container body flange and a corresponding portion of the sidewall of the container body, is disposed between a space between an endpiece flange and a corresponding portion of an endpiece wall, and is further disposed between the endpiece flange and container body flange. As such, the sealing member has a generally S-shaped configuration in cross-section. At least one and preferably two scores are incorporated on the sealing member to facilitate at least a partial removal of the endpiece from the container body so as to be able to access the contents of the container. In another embodiment, a sealing member is removed from between the endpiece and container body, and at least one mechanical purchase exists between the endpiece and container body to provide a "reclosability" feature.

19 Claims, 15 Drawing Sheets

CONTAINER WITH SEALING MEMBER

FIELD OF THE INVENTION

The present invention generally relates to a container and, more particularly, to a container having a sealing member disposed between the container body and an endpiece which is attached thereto.

BACKGROUND OF THE INVENTION

Various types of closures exist for containers. One common closure is a metal endpiece having a push-down tab or the like formed in its central panel and sized considerably less than the central panel. This type of endpiece is typically attached to an open end of a metal container body by a seaming operation, for instance to provide a double seam between the endpiece and container body. These types of closures are commonly used for both beverage and food containers. Any resealing of the container after opening the push-down tab typically requires the use of a plastic overcap of some sort which is separate from the endpiece.

Another type of closure which is commonly used is a metal endpiece which is attached to a container body which may be formed from metal or composite materials (e.g., for various food products, including snack foods such as potato chips). A panel which is substantially the same size as the diameter of the container body is formed in the endpiece and may be completely removed from the endpiece by engaging an appropriate pull-tab or the like. In many of these designs the remainder of the endpiece provides some resistance to the flow out of the container and/or presents sharp edges which may present safety concerns. Any resealing of the container after removal of the panel also typically requires the use of a plastic overcap of some sort which is separate from the endpiece.

Removable foil membranes have also been utilized to seal various foodstuffs within a container. A plastic overcap is typically provided for resealing the container after removal of the foil membrane.

Seals have also been provided between an endpiece and a container body via some type of sealing member which is disposed between and separate from both the endpiece and the container body. One type of sealing member which has been utilized is a sealing member strip which compressively engages a portion of the endpiece against the container body. When removal of the endpiece is desired, the tension in the sealing member is increased to rupture a portion of the endpiece engaged by the sealing member. This leaves the fractured portion of the endpiece attached to the container body by the sealing member, and allows removal of the remainder of the endpiece from the container body. Another type of sealing member which has been commonly used in the juice industry is a simple plastic seal strip which is disposed between a metal endpiece and a composite container body. The plastic sealing strip is pulled out from between these two members when removal of the endpiece is desired.

SUMMARY OF THE INVENTION

The present invention generally relates to a sealing member which is at least partially disposed between a container body and an endpiece. The sealing member provides at least one seal between the container body and endpiece. Moreover, the sealing member also allows the endpiece to be moved away from the container body to dispense contents from the container body (e.g., the endpiece may be totally removed from the container body, the endpiece may be hingedly interconnected with the container body such that it remains attached to the container body even after opening). More specific features of the present invention are discussed below.

A first aspect of the present invention relates to a container which includes a container body having a sidewall which is disposed about a container center axis (e.g., a central, longitudinal reference axis). Appropriate configurations for the container body sidewall include, but are not limited to, cylindrical, oval-shaped, elliptical, rectangular, and square. The container body further includes a container body flange which is generally disposed on a first open end of the container body (e.g., the container body may have another open end which is closed by a separate endpiece, or the opposite end of the container body may be closed by being integrally formed with the noted container body sidewall as in the case of a drawn and ironed container body), which is radially spaced relative to at least a portion of the sidewall (e.g., the container body flange may be disposed further from the container center axis than a corresponding portion of the sidewall, the container body flange may actually be disposed closer to the container center axis than a corresponding portion of the container body sidewall), and which is separated from an opposed portion of the container body sidewall by a first space. The container body flange and the corresponding portion of the sidewall may be integrally formed and define a generally U-shaped structure, with the container body flange having a free end which is generally directed away from the first open end of the container body. Having the container body flange disposed radially outwardly relative to the corresponding portion of the container body sidewall and utilizing the above-noted generally U-shaped structure provides an upper portion for the sidewall of the container body which is free from any edges which could potentially impede the flow out of the container body.

An endpiece is attached to the container body and closes its first open end (e.g., the endpiece and container body may be separately formed, and may in fact be formed from different materials). The endpiece includes an endpiece flange which is disposed at least partially between the container body flange and a first wall of the endpiece (e.g., an endpiece outer wall in the case where the container body flange is disposed radially outwardly of the container body sidewall). The endpiece first wall and endpiece flange may be integrally formed and define a generally U-shaped structure, with the endpiece flange having a free end which is generally directed in the same direction as that in which the first open end of the container body projects (e.g., the free end of the endpiece flange may point or project in the same general direction as the first open end of the container body). A second space separates the endpiece first wall and the endpiece flange, while a third space separates the container body flange and the endpiece flange. A sealing member is disposed in at least a portion of each of the first, second, and third spaces, and a handle is provided for this sealing member. This handle is disposed on the exterior of the container so as to be accessible by a consumer to at least assist in breaking the seal provided by the sealing member to allow the endpiece to be moved away from the container body to gain access to the contents of the container.

Various modifications and/or adaptations may be incorporated into the above-noted container. For instance, the container body and the endpiece may each be formed from the same or different materials, including metals and various other materials. The endpiece may also further include a center panel with an endpiece second wall (e.g., an endpiece inner wall in the case where the container body flange is disposed radially outwardly of the container body sidewall). The endpiece second wall may be disposed about the center panel and seated within an upper portion of the container body sidewall to close the first open end of the container body. This may provide at least one mechanical purchase between the endpiece and container body to realize some kind of seal to be obtained when the endpiece is used to reclose the container body. Other types of mechanical purchases (e.g., snap-lock-like interconnections) may be utilized between the endpiece and container body to provide this reclosability feature. That is, after the sealing member has been removed and/or ruptured to allow the endpiece to be moved away from the container body for a dispensing of its contents, the endpiece may then be reattached to the first open end of the container body with the mechanical purchase providing at least one seal between the container body and the endpiece.

The sealing member in the above-noted first aspect may be formed from a variety of materials, including various resins or plastic/plastic-like materials. A laminated structure may also be utilized for the sealing member, such as by using a layer of a plastic/plastic-like material together with a metal foil or the like which is impermeable in at least some respects. In one embodiment, the sealing member is a one-piece or integrally formed plastic structure having a width such that it has a generally "S-shaped" configuration when disposed in the first, second, and third spaces noted above. Where the container body flange and upper portion of the sidewall of the container body define a generally U-shaped structure with the free end of the container body flange pointing generally away from the first open end of the container body, and where the endpiece flange and endpiece first wall also define a generally U-shaped structure with the free end of the endpiece flange pointing generally in the direction of the first open end of the container body, one end of the sealing member may be disposed in the first space between the upper portion of the sidewall of the container body and the container body flange such that the sealing member extends through the first space, around the free end of the container body flange, through the third space between the container body flange and the endpiece flange, around the free end of the endpiece flange, and then into the second space between the endpiece first wall and the container body flange.

The "length" of the sealing member is preferably such that it substantially or totally surrounds the container. This may be provided by molding the sealing member as a closed ring-like structure which would then be disposed over the upper end of the container body during assembly. This may also be provided by forming the sealing member to have two ends. These ends may be disposed in abutting relation by "wrapping" the sealing member about the container during assembly, or by disposing the ends in overlapping relation.

At least one generally longitudinally extending score (e.g., a score which extends at least generally in the direction of the length of the sealing member) may be incorporated on the sealing member to provide a predetermined rupture pattern to allow the endpiece to be moved away from the container body. Two or more "longitudinally extending" scores may be included on the sealing member to define at least two predetermined rupture locations. Two or more scores may be disposed on either surface of the two primary surfaces of the sealing member which define the "width" of the sealing member (e.g,. two scores on a first surface of the sealing member, two scores on a second surface of the sealing member which is opposite the first surface), or at least one score may be disposed on each of these two primary surfaces of the sealing member. Moreover, the first and/or second scores need not be over the entire "length" of the sealing member. A hinged interconnection between the endpiece and container body may be realized by leaving a certain segment of the sealing member "unscored" which will define the hinge. This "unscored" section may be disposed adjacent to the handle and at the "end" of the sealing member opposite the handle (e.g., such that the handle may be pulled about the container to rupture the score(s) before reaching the "unscored" region which defines the hinge).

The handle of the sealing member or a portion interconnected therewith may extend through a score and interface with an enlarged head which is disposed within an interior region of the sealing member and which facilitates a rupturing of the score(s). The enlarged head may be disposed in a space between the sealing member and the free end of the container body flange.

Each of these features discussed above in relation to the first aspect may be used alone or in any combination.

A second aspect of the present invention relates to a method for attaching an endpiece to a first open end of a container body. The method includes the steps of forming a first hooked portion (e.g,. annular) on a free end of the container body to dispose the first hooked portion generally on the first open end, and forming a second hooked portion (e.g., annular) on a free end of the endpiece. A sealing member is positioned relative to each of the endpiece and the container body so as to be disposed in each of the first and second hooked portions. This may be affected by first forming the first and/or second hooked portions and then disposing the sealing member therein, by partially forming the first and/or second hooked portions and then disposing the sealing member therein, and/or by forming the first and/or second hooked portions about the sealing member. Appropriate positioning of the sealing member may be affected by adhering the sealing member to the container body in some manner so as to maintain its position during formation of the first and/or second hooked portions. The endpiece is disposed relative to the first open end of the container body such that the second hooked portion of the endpiece may be moved relative to the first hooked portion to move the first and second hooked portions toward each other to at least assist in attaching the endpiece to the container body.

Various modifications and/or adaptations may be incorporated into the above-noted methodology. Formation of the first and/or second hooked portions may be used to encase and/or compressively retain a corresponding portion of the sealing member therein. The movement of the second hooked portion of the endpiece relatively toward the first hooked portion of the container body may be a pivoting-like or bending like motion. This movement of the second hooked portion of the endpiece relatively toward the first hooked portion of the container body may also compress the first and second hooked portions together, and may further dispose a portion of the sealing member between the first and second hooked portions.

A third aspect of the present invention relates to a container which includes a container body having a sidewall which is disposed about a container body axis (e.g., a central, longitudinal reference axis). Appropriate configurations for the container body sidewall include, but are not limited to, cylindrical, oval-shaped, elliptical, rectangular, and square. The container body further includes a container body flange which is interconnected with an upper portion of the container body sidewall and which is generally disposed on a first open end of the container body (e.g., the container body may have another open end which is closed by a separate endpiece, or the opposite end of the container body may be closed by being integrally formed with the noted container body sidewall as in the case of a drawn and ironed container body).

An endpiece is attached to and closes the first open end of the container body (e.g., the endpiece and container body may be separately formed, and may be formed from the same or different materials). The endpiece includes an endpiece flange which is resiliently biased toward the container body flange to provide a reclosability feature discussed in more detail below.

A sealing member is disposed at least partially between the container body flange and the endpiece flange, and is preferably compressively engaged therebetween. The sealing member includes a handle which extends away from the area between the container body flange and the endpiece flange so as to be accessible by a consumer exteriorly of the container. At least part of the sealing member is pulled out from between the container body flange and the endpiece flange to allow the endpiece to be moved away from the container body to gain access to the contents of the container (e.g., the endpiece may be totally removable from the container body). This "pulling out" of the sealing member from between the endpiece flange and container body flange will be for at least a portion of the "length" of the sealing member, and will typically be for the total "length" of the sealing member such that the sealing member is totally removed from between the container body and endpiece. The resiliently biased nature of the endpiece flange allows the endpiece to be used to reclose the container body after the sealing member has been removed as noted above. Specifically, when the endpiece is reattached to the container body, at least a portion of the endpiece flange engages at least a portion of the container body flange to provide at least one mechanical purchase between the endpiece and the container body to facilitate reclosure.

Various modifications and/or adaptations may be incorporated into the above-noted container. For instance, the container body flange may flushly engage the upper portion of the sidewall of the container body. Moreover, the container body flange may be disposed radially outwardly of the upper portion of the sidewall of the container body. Furthermore, the container body flange may be disposed generally parallel with the container center axis or may be angled relative thereto (e.g., the container body flange may be disposed in a diverging relation to the container center axis).

The endpiece of this third aspect may further include a first endpiece wall and a second endpiece wall, with the first endpiece wall being disposed radially inwardly of the upper portion of the sidewall of the container body in at least partial engagement therewith and with the second endpiece wall being disposed radially outwardly of both the first endpiece wall and the endpiece flange, and with the endpiece flange being disposed radially outwardly of the container body flange. In this case, the endpiece flange and the container body flange may be disposed in substantially parallel relation and may compressively retain the sealing member therebetween. Alternatively, the endpiece flange may be arcuately shaped with its convex side projecting toward the container body flange to compressively retain the sealing member therebetween.

The endpiece of the subject third aspect may further include a central panel which is generally dome-shaped in such a manner that the "public" side of the central panel of the endpiece (i.e., that which defines an exterior surface of the container body) is generally convexly-shaped. This configuration may assist in the removal of the endpiece from the container body. After the sealing member has been removed from between the endpiece flange and the container body flange, there may still be at least one or more mechanical purchases between the endpiece and the container which seals the interior of the container. In some cases the interior of the container is at substantially a vacuum (e.g., for certain food product applications). Pressing down on the generally domed central panel may unseat these various mechanical purchases to relieve the vacuum within the interior of the container to allow the endpiece to be more easily moved away from the container body to gain access to the contents of the container.

The sealing member of the subject third aspect may be ring-like such that the sealing member is disposed over the upper portion of the container body during the assembly of the container. Alternatively, the sealing member may have two ends such that the sealing member is effectively "wrapped" around the container body during assembly of the container. In this case, the first and second ends may be disposed in overlapping relation, and further these two ends of the sealing member may be secured together (e.g., adhesively, heat sealing). Moreover, the first and second ends could be disposed in substantial abutting relation (with or without being secured together).

A fourth aspect of the present invention generally relates to a container which includes a container body having a sidewall which is disposed about a container center axis (e.g., a central, longitudinal reference axis). The container body further includes a container body flange which is interconnected with an upper portion of the container body sidewall, and which is disposed on a first open end of the container body.

The container of the subject fourth aspect further includes an endpiece which closes the above-noted first open end of the container body. This endpiece includes an endpiece flange and a central panel which is disposed radially inwardly of the upper portion of the sidewall of the container body. The central panel is generally dome-shaped and the "public side" thereof (e.g., that surface which defines an exterior surface of the container) is generally convexly-shaped, or stated another way such that the central panel bulges generally in a direction which the first open end of the container body projects.

Finally, the container of the subject fourth aspect includes a sealing member which is at least partially disposed between the container body flange and the endpiece flange. The sealing member includes a handle which extends away from the area between the endpiece flange and container body flange to be accessible by a consumer exteriorly of the container. Movement of the handle of the sealing member about the container may pull the sealing member out from between the endpiece flange and container body flange, and/or may rupture the sealing member to allow the endpiece to be moved away from the container body to gain access to the contents of the container. The above-noted configuration of the central panel facilitates this "removal" of the endpiece from the container body. After the seal provided by the sealing member has been alleviated by the above-noted motion of the handle, there may still be at least one or more mechanical purchases between the endpiece and the container which still seals the interior of the container to at least a degree. In some cases the interior of the container is at substantially a vacuum (e.g., for certain food product applications). Pressing down on the generally domed central panel unseats these various mechanical purchases to relieve the vacuum within the interior of the container to allow the endpiece to be more easily moved away from the container body to gain access to the contents of the container.

DETAILED DESCRIPTION

Figure 1:
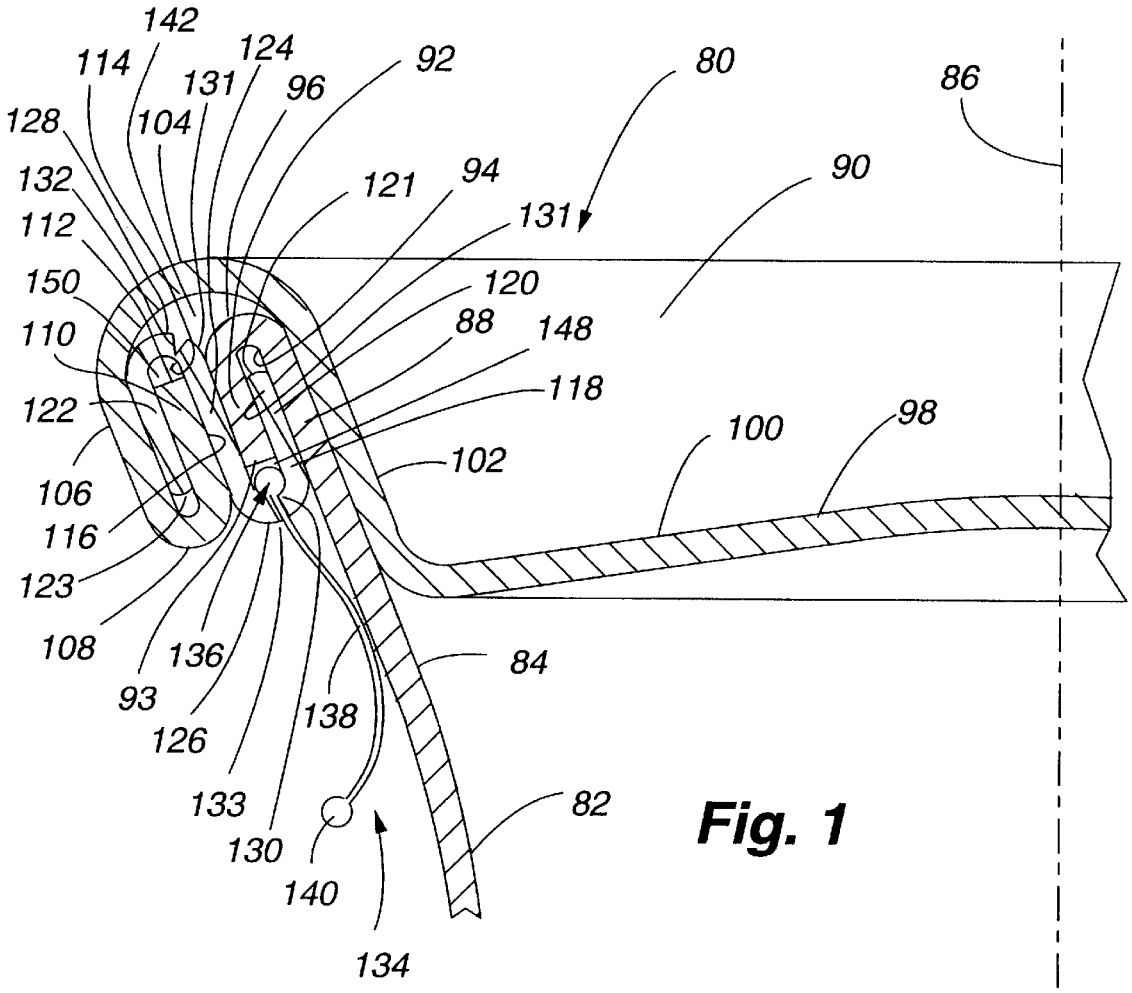
FIG. 1 is cross-sectional view of one embodiment of a container which includes a sealing member and a separate endpiece which is attached thereto.

One embodiment of a container with a sealing member or the like is illustrated in FIG. 1. The container 80 of FIG. 3 includes a container body 82 with an endpiece 98 which is attached thereto in a manner such that it is totally removable from the container body 82. The end of the container body 82 opposite that sealed by the endpiece 98 may be closed by another endpiece of the same or a different design (i.e., to provide a three-piece container design) or may be integrally formed with the sidewall 84 of the container body 82 (i.e., to provide a two-piece container design). The container body 82 may be formed from a metal or a metal alloy or various other materials, and includes the sidewall 84 which is disposed about a container central axis 86. An upper portion of the sidewall 84 includes a first sidewall portion 88 which diverges away from the container central axis 86. The upper extreme of the sidewall 84 is defined by a container body rim 96 which in turn defines a first open end 90 for the container body 82 which is closed by the endpiece 98 in a manner discussed below.

The container body 82 further includes a container body flange 92 which is interconnected with the first sidewall portion 88 by the container body rim 96. The container body flange 92 is separated from the first sidewall portion 88 by an annular first space 94 ("annular" in the sense used herein means that it encircles or surrounds the container central axis 86 or other relevant structure, but does not require a circular configuration per se), is disposed in substantially parallel relation with the first sidewall portion 88, extends downwardly from the container body rim 96 or in a direction which is generally directed away from the first open end 90 of the container body 82, has an annular free end 93, and is disposed further from the container central axis 86 than the first sidewall portion 88.

The endpiece 98 is formed from a metal or a metal alloy or various other materials, is a separate piece from the container body 82, is appropriately attached thereto (e.g., via a seaming operation to be discussed below), and is totally removable from the container body 82. Other embodiments utilize a hinged interconnection as will be discussed below in relation to FIGS. 9-10. The endpiece 98 of FIG. 1 includes a generally domed center panel 100 which in the illustrated embodiment has no apertures therein and no push-down tab(s) or the like. The generally domed center panel 100 may be utilized to vent the container 80 after a seal provided by a sealing member 118 disposed between the endpiece 98 and container body 82 is ruptured in a manner discussed in more detail below. A substantially flat center panel (not shown) which is disposed generally perpendicularly to the container central axis 86 could be utilized as well (not shown). In this case or even in the illustrated domed configuration, it may be desirable to include at least one push-down tab or the like on the center panel (not shown).

An annular endpiece inner wall 102 extends upwardly from the center panel 100 and away from the container central axis 86 (other embodiments have this wall disposed generally parallel to the container central axis as will be discussed below, and these configurations may be used here as well), is disposed radially inwardly of the first sidewall portion 88 relative to the container central axis 86, and is substantially flushly engaged with the first sidewall portion 88 (e.g., the endpiece inner wall 102 is disposed in substantial parallel relation with the first sidewall portion 88). In one embodiment, the endpiece inner wall 102 and the first sidewall portion 88 are substantially flushly engaged over a linear distance of at least about 0.020 inch.

Figure 1A:
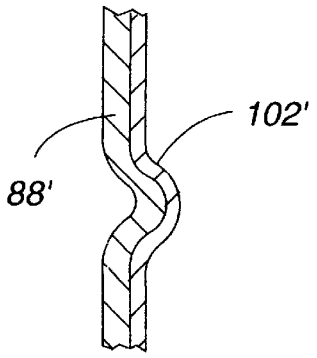
FIG. 1A is an alternative configuration for the container of FIG. 1 which provides a snap-lock-like interconnection.

The endpiece inner wall 102 and first sidewall portion 88 may be disposed substantially parallel to the container center axis 86, as noted above. In this case, there may also be a press-fit or the like between the endpiece inner wall 102 and the first sidewall portion 88 to provide a mechanical purchase between the endpiece 98 and the container body 82 which may be desirable when resealing the container body 82 with the endpiece 96. Moreover, the endpiece inner wall 102 and/or first sidewall portion 88 may be configured to provide a snap-lock-like interconnection between the endpiece 98 and container body 82, as illustrated in FIG. 1A. These two features may be included on all embodiments disclosed herein, where the endpiece inner wall and the first sidewall portion are disposed substantially parallel with the container center axis.

The endpiece 98 further includes an annular endpiece outer wall 106 which is disposed radially outwardly from the endpiece inner wall 102 relative to the container central axis 86. The endpiece outer wall 106 is disposed in substantial parallel relation with both the endpiece inner wall 102 and the first sidewall portion 88 of the container body 82. An annular endpiece upper crown or rim 104 interconnects the endpiece inner wall 102 and endpiece outer wall 106. This endpiece upper crown 104 defines the uppermost portion of the endpiece 98 and in one embodiment is substantially defined by a constant radius.

An endpiece flange 110 is interconnected with the endpiece outer wall 106 by an annular endpiece lower rim 108 which is substantially defined by a constant radius. Separating the endpiece flange 110 and the endpiece outer wall 106 is an annular second space 114 which disposes the endpiece flange 110 radially inwardly of the endpiece outer wall 106 (i.e., the endpiece flange 110 is disposed closer to be container central axis 86 than the endpiece outer wall 106). The endpiece flange 110 extends upwardly from the endpiece lower rim 108, or generally in the direction of the first open end 90 of the container body 82, and is disposed in substantial parallel relation with the endpiece outer wall 106, and thereby the container body flange 92 and the endpiece inner wall 102. An annular free end 112 of the endpiece flange 110 projects generally in the direction of the first open end 90 of the container body 82 and is separated from the interior surface of the endpiece upper crown 104 by a space 142. In another embodiment, the size of the space 142 is reduced and in another embodiment is effectively totally eliminated (not shown).

The endpiece flange 110 is disposed between the endpiece outer wall 106 and the container body flange 92. As such, the endpiece flange 110 is disposed radially outwardly of the container body flange 92, relative to the container central axis 86. An annular third space 116 separates the endpiece flange 110 and the container body flange 92.

At least one seal between the above-noted container body 82 and the endpiece 98 is provided by the sealing member 118, which is a separate structure from both the container body 82 and endpiece 98. Suitable materials for the sealing member 118 to provide its sealing function between the container body 82 and the endpiece 98 include, but are not limited to, various resinous materials (e.g., plastic or plastic-like materials, such as polypropylene thermoset plastic). The sealing member 118 extends substantially about, and more preferably totally about, the entire arcuate or annular extent of the container 80 (i.e., "encircles" as noted above). That is, the sealing member 118 has a substantially annular extent, and more preferably an annular extent, when installed on the container 80. This may be provided by having the sealing member 118 be formed as an integral ring-like structure (e.g., injection molded). Another possibility is for the sealing member 118 to have two ends such that the sealing member 118 is wrapped around the container body 82. The two ends of the sealing member 188 may be disposed in substantial abutting relation or may be disposed in overlapping relation. In either case, the two ends of the sealing member may be suitably joined together.

In cross-section and as illustrated in FIG. 1, the sealing member 118 has a generally S-shaped configuration based upon the manner in which it interfaces with the container body 82 and the endpiece 98. The sealing member 118 includes an annular first sealing member portion 120 which is disposed in the annular first space 94 between the first sidewall portion 88 of the container body 82 and the container body flange 92. A first longitudinal edge 121 of the sealing member 118 is separated from the interior surface of the container body upper crown 104 by a gap (i.e., the first sealing member portion 120 does not occupy the entire first space 94) in the illustrated embodiment. However, in another embodiment the sealing member 118 does occupy substantially the entire first space 94 (not shown). Enhanced sealing of the container 80 is provided by the first sealing member portion 120 being compressed between the first sidewall portion 88 of the container body 82 and the container body flange 92.

The sealing member 118 further includes an annular second sealing member portion 122 which is disposed in the annular second space 114 between the endpiece outer wall 106 and the endpiece flange 110. A second longitudinal edge 123 of the sealing member 118 is separated from the interior surface of the endpiece lower rim 108 by a gap (i.e., the second sealing member portion 122 does not occupy the entire second space 114) in the illustrated embodiment. However, in another embodiment the sealing member 118 does occupy substantially the entire second space 114 (not shown). Enhanced sealing of the container 80 is provided by the second sealing member portion 122 being compressed between the endpiece outer wall 106 and the endpiece flange 110.

The sealing member 118 further includes an annular third sealing member portion 124 which is disposed in the annular third space 116 between the endpiece flange 110 and the container body flange 92. Enhanced sealing of the container 80 is provided by the third sealing member portion 126 being compressed between the endpiece flange 110 and the container body flange 92.

The annular first sealing member portion 120 is integrally interconnected with the annular third sealing member portion 124 by an annular first sealing member interconnecting portion 126. This first sealing member interconnecting portion 126 is disposed below the free end 93 of the container body flange 92 and is separated therefrom by an annular space 148. The first sealing member interconnecting portion 126 is accessible on and defines a portion of the exterior surface of the container 80.

The annular second sealing member portion 122 is integrally interconnected with the annular third sealing member portion 124 by an annular second sealing member interconnecting portion 128. This second sealing member interconnecting portion 128 is disposed above the free end 112 of the endpiece flange 110 and is separated therefrom by an annular space 150 in the illustrated embodiment. However, in another embodiment this space 150 does not exist (not shown). The second sealing member interconnecting portion 128 may engage at least a portion of the interior surface of the endpiece upper crown 104 or may be totally separated therefrom by the space 142.

Figure 3:
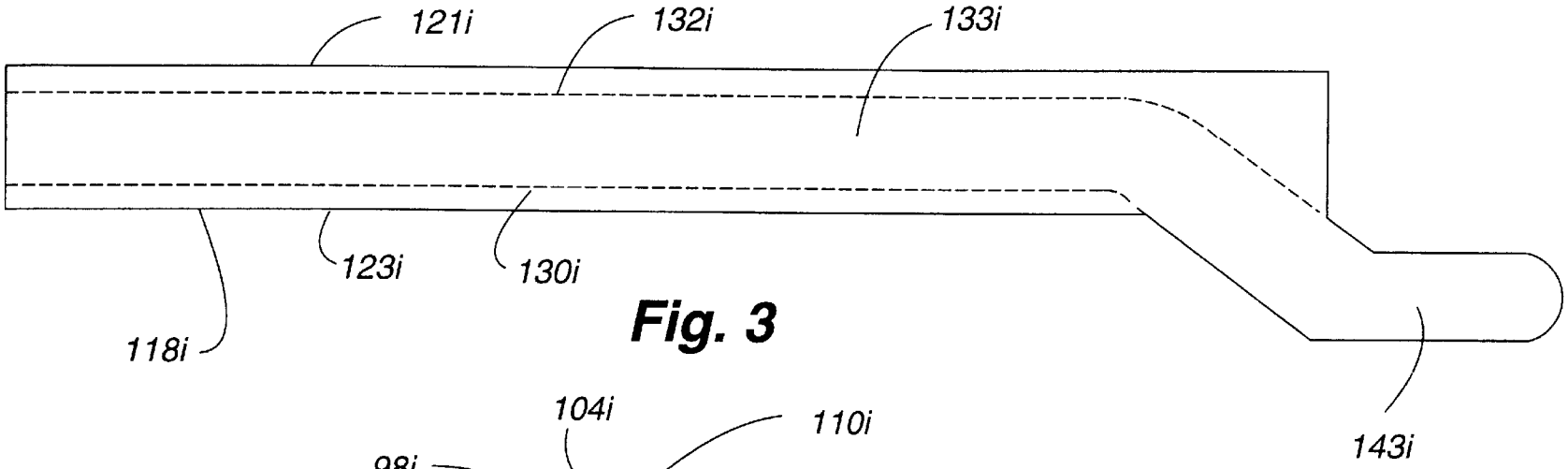
FIG. 3 is an enlarged plan view of the sealing member used in the container of FIG. 3.

Removal of the endpiece 98 from the container body 82 to dispense its contents is affected by rupturing the sealing member 118 in a predetermined manner. In this regard, the sealing member 118 includes a first score 130 which is disposed on the first sealing member interconnecting portion 126 on a first surface 131 of the sealing member 118, and a second score 132 which is disposed on the second sealing member interconnecting portion 128 on the first surface 131 as well (i.e., the scores 130 and 132 are positioned on the same "side" of the sealing member 118). The scores 130 and 132 have a substantially annular extent, and more preferably a total annular extent, when the sealing member 118 is installed on the container 80. Similar scores are illustrated in FIG. 3 to be discussed in more detail below.

Rupturing of the first score 130 is provided by a score rupture assembly 134. The score rupture assembly 134 includes a head 136 which is disposed in the space 148. An extension member 138 is interconnected with the head 136 and extends through the first score 130 for access on the exterior of the container 80. The sealing member 118 is suitably sealed about the extension member 138. A handle 140 is provided on the end of the extension member 138 to facilitate use of the rupture assembly 134 by a consumer.

The endpiece 98 is totally removed from the container body 82 to access the contents of the container 80 by the annular extent of the first and second scores 130, 132. The consumer grabs the extension member 138 or the handle 140 and pulls the head 136 about the entire annular extent of the space 148 or about the container 80. This then causes the extension member 138 to progressively rupture the entire annular extent of the first score 130. The tension introduced in the sealing member 118 by this movement also ruptures the second score 132. The consumer may then grasp the endpiece 98 to pull the same away from the container body 82. It should be appreciated that there are no edges or the like on the upper portion of the sidewall 84 which could impede the flow out of the container body 82 based upon the type of interconnection utilized between the endpiece 98 and the container body 82. The hinged interconnection discussed in relation to FIGS. 9-10 may be used in the FIG. 1 embodiment as well.

The container 80 is also reclosable in that the endpiece 98 may be reattached to the container body 82. When the endpiece innerwall 102 and the first sidewall portion 88 are disposed substantially parallel with the container center axis 86, a press-fit between the endpiece inner wall 102 and the first sidewall portion 88 of the container body 82 will provide at least one mechanical purchase between the endpiece 98 and the container body 82 to seal the container 80. Another mechanical purchase between the endpiece 98 and the container body 82 may be provided by the endpiece flange 110 being biased so as to come into mechanical engagement with the container body flange 92 after the scores 130 and 132 are ruptured and after the third sealing member portion 124 is removed. Rupturing of the scores 130 and 132 results in the section of the sealing member 118 between the scores 130 and 132 being totally removed when the endpiece 98 is removed from the container body 82, including the third sealing member portion 124 which as shown in FIG. 1 is originally disposed between the endpiece flange 110 and the container body flange 92. Yet another mechanical purchase may be realized by using the type of snap-lock-like interconnection shown in FIG. 1A.

Another embodiment of a container which utilizes a sealing member or the like is generally depicted in FIGS. 2–5. The container $\mathbf{80}^i$ has the same types of parts as the container 80 of FIG. 1 discussed above, although sizes, relative positionings, and/or orientations of the various identified parts may differ. Therefore, a superscripted "i" is used to identify the parts in FIGS. 2–5 which generally correspond with those in FIG. 1, but which may differ therefrom in some respect.

Figure 4:
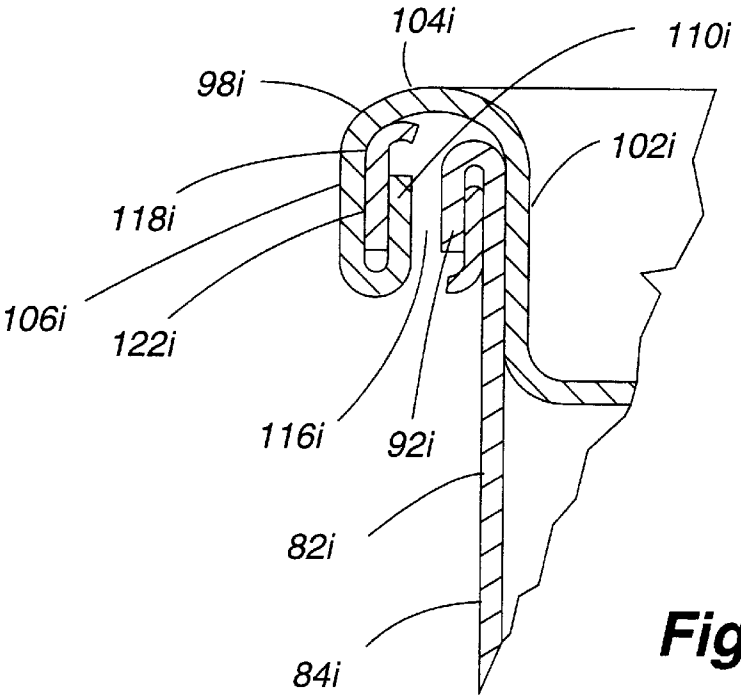
FIG. 4 is a cross-sectional view of the container of FIG. 2 after the sealing member has been ruptured and after the endpiece has been reattached.

The container $\mathbf{80}^i$ includes a container body $\mathbf{84}^i$ which is disposed about a container central axis $\mathbf{86}^i$. The container body $\mathbf{84}^i$ includes a pair of open ends which are each sealed by an endpiece (i.e., of the same or different construction). A sealing member $\mathbf{118}^i$ is provided between the interconnection of at least one of the endpieces $\mathbf{98}^i$ (typically only one) and the container body $\mathbf{84}^i$ to provide the above-noted advantages. Generally, the only substantial difference between the sealing member $\mathbf{118}^i$ and the sealing member 118 discussed above in relation to FIG. 1 is in relation to the score rupture assembly 134 as illustrated in FIG. 3. The sealing member $\mathbf{118}^i$ includes the first and second scores $\mathbf{130}^i$ and $\mathbf{132}^i$ which are each disposed on the first surface $\mathbf{131}^i$ of the sealing member $\mathbf{118}^i$. Instead of using the rupture assembly 134, however, the sealing member $\mathbf{118}^i$ merely includes a handle $\mathbf{143}^i$. Both the first score $\mathbf{130}^i$ and the second score $\mathbf{132}^i$ are ruptured by a consumer pulling on the handle $\mathbf{143}^i$ and advancing the same about the entire annular extent of the container $\mathbf{80}^i$. FIG. 4 illustrates the container $\mathbf{80}^i$ after the sealing member $\mathbf{118}^i$ has been broken and/or after the container body $\mathbf{82}^i$ is reclosed by endpiece $\mathbf{98}^i$, that is after the sealing member $\mathbf{118}^i$ has been ruptured along the first and second scores $\mathbf{130}^i$, $\mathbf{132}^i$ and the endpiece $\mathbf{98}^i$ has been removed to access the contents of the container $\mathbf{80}^i$.

Figure 5C:
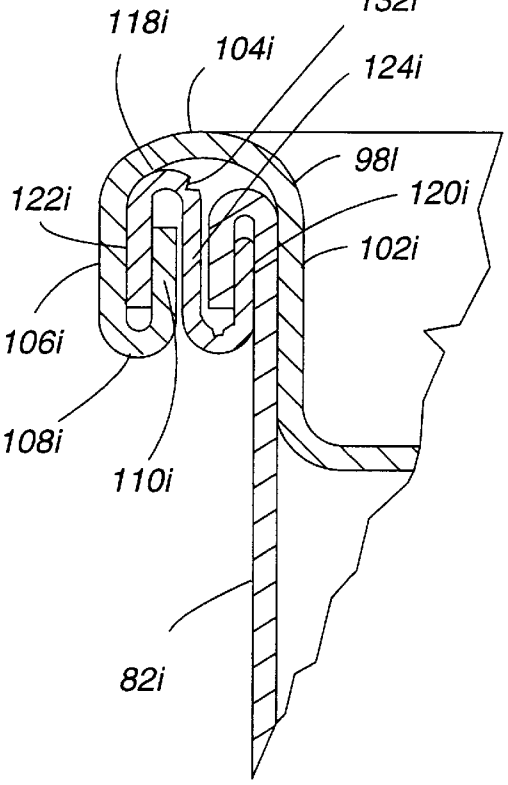
FIGS. 5A–C illustrate a method for assembling the container of FIG. 2.
Figure 5B:
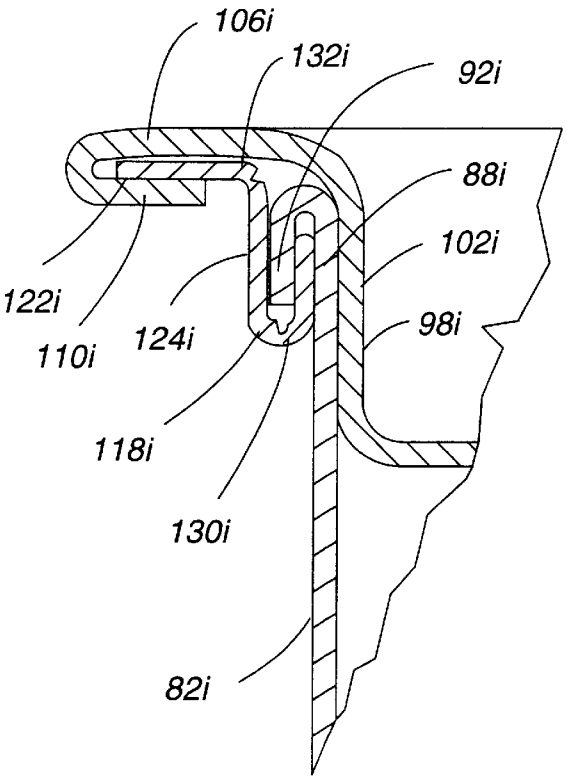
Figure 5A:
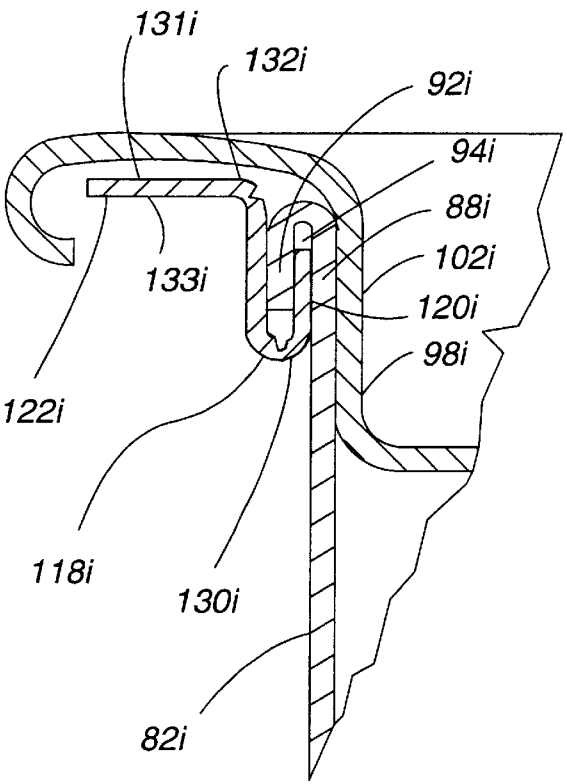

The manner in which the sealing member $\mathbf{118}^i$ is incorporated into the design of the container $\mathbf{80}^i$ is illustrated in FIGS. 5A–C. The same general methodology will equally apply to the FIG. 1 embodiment, as well as other embodiments disclosed herein. Initially, the first sealing member portion $\mathbf{120}^i$ may be adhered to the sidewall $\mathbf{84}^i$ (e.g., the first sidewall portion $\mathbf{88}^i$) of the container body $\mathbf{82}^i$ or otherwise retained to insure a proper positioning of the sealing member $\mathbf{118}^i$ on the finished container $\mathbf{80}^i$. The first sealing member portion $\mathbf{120}^i$ may be disposed within the annular first space $\mathbf{94}^i$ between the container body flange $\mathbf{92}^i$ and the first sidewall portion $\mathbf{88}^i$, or alternatively the first sealing member portion $\mathbf{120}^i$ may be positioned relative the container body $\mathbf{82}^i$ so as to be encased in the annular first space $\mathbf{94}^i$ as a result of the formation of the container body flange $\mathbf{92}^i$. For instance, the first sealing member portion $\mathbf{120}^i$ may be positioned so as to be disposed between the container body flange $\mathbf{92}^i$ and the first sidewall portion $\mathbf{88}^i$ as the container body flange $\mathbf{92}^i$ is formed from an upper cylindrical portion of the sidewall of the container body $\mathbf{82}^i$.

When the endpiece $\mathbf{98}^i$ is installed on the first open end $\mathbf{90}^i$ of the container body $\mathbf{82}^i$, the endpiece flange $\mathbf{110}^i$ need not yet have been formed as illustrated in FIG. 5A. The sealing member $\mathbf{118}^i$ need only be positioned so as to dispose the second sealing member portion $\mathbf{122}^i$ in the annular second space $\mathbf{114}^i$ after the endpiece flange $\mathbf{110}^i$ is formed and as illustrated in FIG. 5B. After the second sealing member portion $\mathbf{122}^i$ is disposed in at least a partially formed second space $\mathbf{114}^i$, the endpiece outer wall $\mathbf{106}^i$ and the endpiece flange 110$^{i}$ may be pivoted about an annular reference axis to dispose the third sealing member portion 124$^{i}$ between the container body flange 92$^{i}$ and the endpiece flange 110$^{i}$ as illustrated in FIG. 5C. At this time the endpiece outer wall 106$^{i}$, endpiece flange 110$^{i}$, container body flange 92$^{i}$, and first sidewall portion 88$^{i}$ may be further compressed together (not shown) to provide a suitable seal between the endpiece 98$^{i}$ and the container body 82$^{i}$. This will then compressively retain the sealing member 118$^{i}$ in the first, second, and third spaces 94$^{i}$, 114$^{i}$, and 116$^{i}$ to further enhance the seal between the container body 82$^{i}$ and the endpiece 98$^{i}$.

Figure 6:
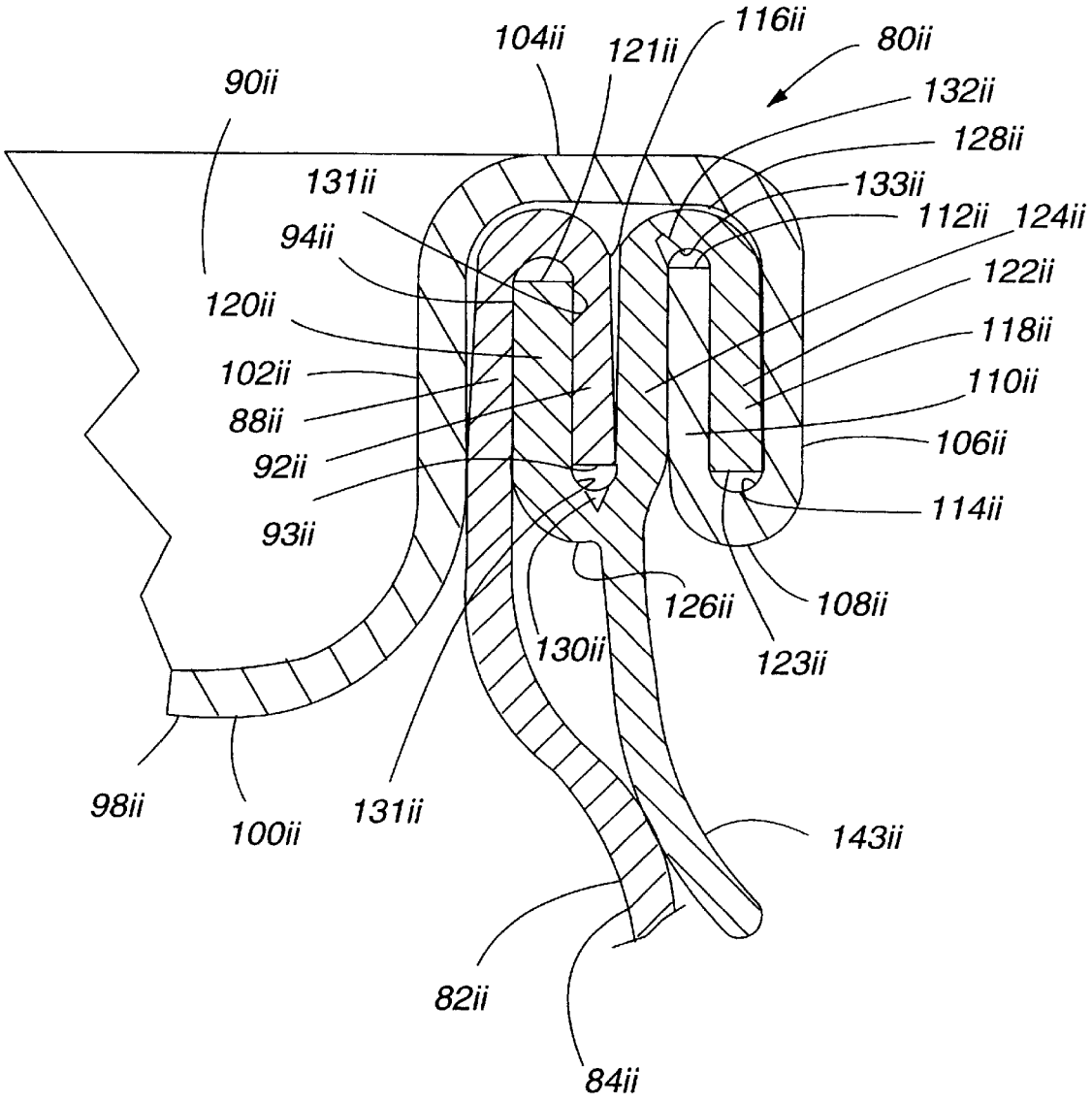
FIG. 6 is cross-sectional view of another embodiment of a container which includes a sealing member and an endpiece.

Another embodiment of a container which utilizes a sealing member or the like is generally depicted in FIG. 6. The container 80$^{ii}$ s has the same types of parts as the container 80 of FIG. 1 discussed above, although sizes, relative positionings, and/or orientations of the various identified parts may differ. Therefore, a superscripted "ii" is used to identify the parts in FIG. 6 which generally correspond with those in FIG. 1, but which may differ therefrom in some respect.

There are a number of differences between the container 80 and the container 80$^{ii}$. One difference is the orientation of the upper portion of the container body 82$^{ii}$. The first sidewall portion 88$^{ii}$, the container body flange 92$^{ii}$, the endpiece inner wall 102$^{ii}$, the endpiece outer wall 106$^{ii}$, and the endpiece flange 110$^{ii}$ are each disposed substantially parallel with the container central axis 86$^{ii}$. Contrast this with the FIG. 1 embodiment in which a generally divergent orientation is utilized for these parts of the container 80.

Figure 2:
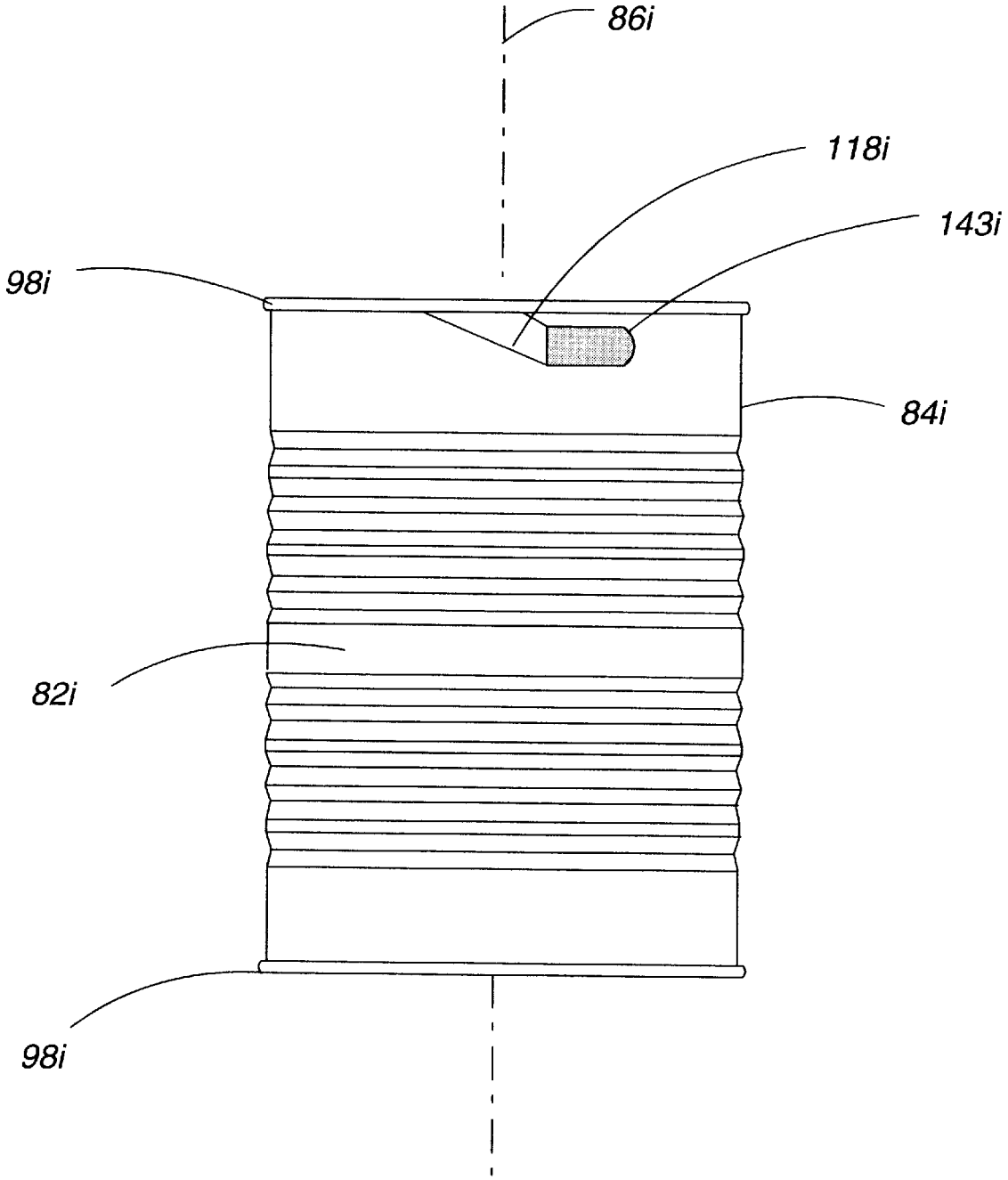
FIG. 2 is a side view of another embodiment of a container which includes a sealing member and an endpiece which is attached thereto and which is a variation of the container of FIG. 1.

The sealing member 118$^{ii}$ of FIG. 6 also differs from the sealing member 118 presented in FIG. 1, and is generally similar to the sealing member 118$^{i}$ from the FIG. 2 embodiment. There are also differences between the sealing member 118$^{ii}$ and the sealing member 118$^{i}$, however. For instance, the first score 130$^{ii}$ and the second score 132$^{ii}$ are disposed on opposite surfaces of the sealing member 118$^{ii}$, whereas in the case of the sealing member 118$^{i}$, the first score 130$^{i}$ and second score 132$^{i}$ are disposed on the same surface of the sealing member 118$^{i}$. Specifically, the first score 130$^{ii}$ in FIG. 6 is disposed on the first surface 131$^{ii}$ of the sealing member 118$^{ii}$, while the second score 132$^{ii}$ is disposed on the second surface 133$^{ii}$ of the sealing member 118$^{ii}$. Other features discussed above in relation to FIGS. 1 and/or 2 may be utilized in this embodiment as well (e.g., incorporating a snap-lock-like interconnection, a hinged interconnection, a press fit, a diverging orientation for the upper portion of the container).

Figure 7:
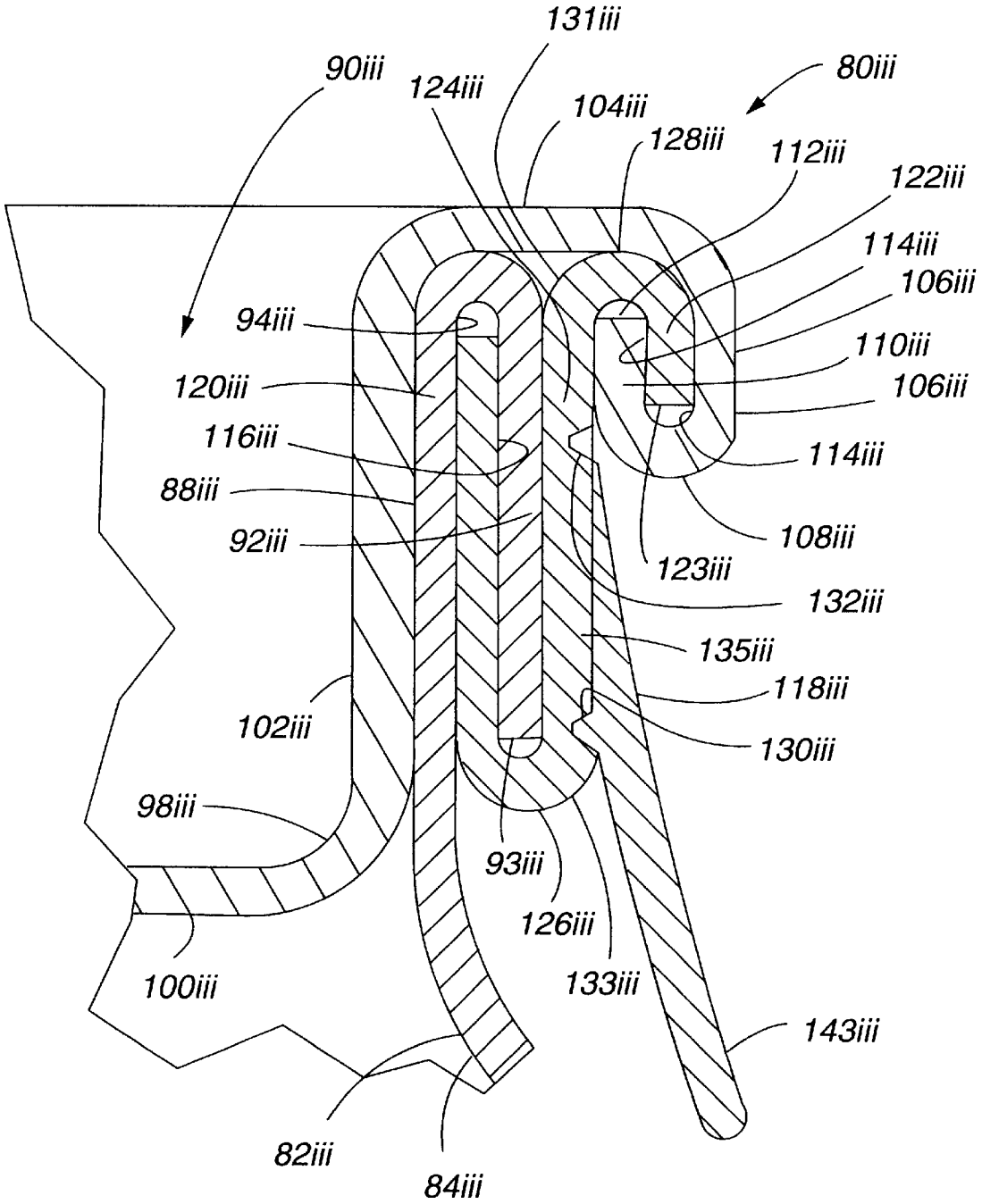
FIG. 7 is cross-sectional view of another embodiment of a container which includes a sealing member and an endpiece.

Another embodiment of a container which utilizes a sealing member or the like is depicted in FIG. 7. The container 80$^{iii}$ has the same types of parts as the container 80 of FIG. 1 discussed above, although sizes, relative positionings, and/or orientations of the various identified parts may differ. Therefore, a superscripted "iii" is used to identify the parts in FIG. 7 which generally correspond with those in FIG. 1, but which may differ therefrom in some respect.

There are a number of differences between the container 80 and the container 80$^{iii}$. One difference is the orientation of the upper portion of the container body 82$^{iii}$. The first sidewall portion 88$^{iii}$, the container body flange 92$^{iii}$, the endpiece inner wall 102$^{iii}$, the endpiece outer wall 106$^{iii}$, and the endpiece flange 110$^{iii}$ are each disposed substantially parallel with the container central axis 86$^{iii}$. Contrast this with the FIG. 1 embodiment in which a generally divergent orientation is utilized for these parts of the container 80. Moreover, the endpiece lower rim 108$^{iii}$ and the free end 93$^{iii}$ of the container body flange 92$^{iii}$ are not at the same general longitudinal position (e.g., along an axis generally parallel with the container central axis), but are longitudinally offset. Stated another way, the length of the endpiece flange 110$^{iii}$ and the length of the container body flange 92$^{iii}$ are different in the case of the FIG. 7 embodiment, whereas in the FIG. 1 embodiment the length of the endpiece flange 110 is substantially the same as the length of the container body flange 92.

The sealing member 118$^{iii}$ of FIG. 7 also differs from the sealing member 118 presented in FIG. 1, and is generally similar to the sealing member 118$^{ii}$ from the FIG. 6 embodiment. There are also differences between the sealing member 118$^{iii}$ and the sealing member 118$^{ii}$, however. For instance, the first score 130$^{iii}$ and the second score 132$^{iii}$ are each disposed on the same surface of the sealing member 118$^{iii}$, whereas in the case of the sealing member 118$^{ii}$, the first score 130$^{ii}$ and second score 132$^{ii}$ are disposed on opposite surfaces of the sealing member 118$^{ii}$.

The sealing member 118$^{iii}$ of FIG. 7 also differs from the sealing member 118 of FIG. 1 and the sealing member 118$^{i}$ of FIG. 2 in relation to the surface on which the scores are disposed. Specifically, the first score 130$^{iii}$ and the second score 132$^{iii}$ are each disposed on the second surface 133$^{iii}$ in the case of the sealing member 118$^{iii}$ of FIG. 7. In contrast, the first score 130 and second score 132 are each disposed on the first surface 131 in the case of the sealing member 118 of FIG. 1.

The positioning of the scores relative to the endpiece also differs between the FIG. 7 embodiment and each of the FIG. 1 and 6 embodiments. Specifically, the first and second scores 130$^{iii}$, 132$^{iii}$ are each disposed such that a segment 135$^{iii}$ there between is not retained between the container body 82$^{iii}$ and the endpiece 98$^{iii}$ which differs from the FIGS. 1 and 6 embodiments. When the segment 135$^{iii}$ is removed after a rupturing of the scores 130$^{iii}$ and 132$^{iii}$, the third sealing member portion 124$^{iii}$ of the sealing member 118$^{iii}$ still remains to provide a seal between the endpiece 98$^{iii}$ when it is reattached to the container body 82$^{iii}$. This differs from both the FIG. 1 and 6 embodiments discussed above. Other features discussed above in relation to the embodiments of FIGS. 1, 2, and/or 6 may be utilized in this embodiment as well (e.g., incorporating a snap-lock-like interconnection, a hinged interconnection, a press fit, a diverging orientation for the upper portion of the container).

Figure 8:
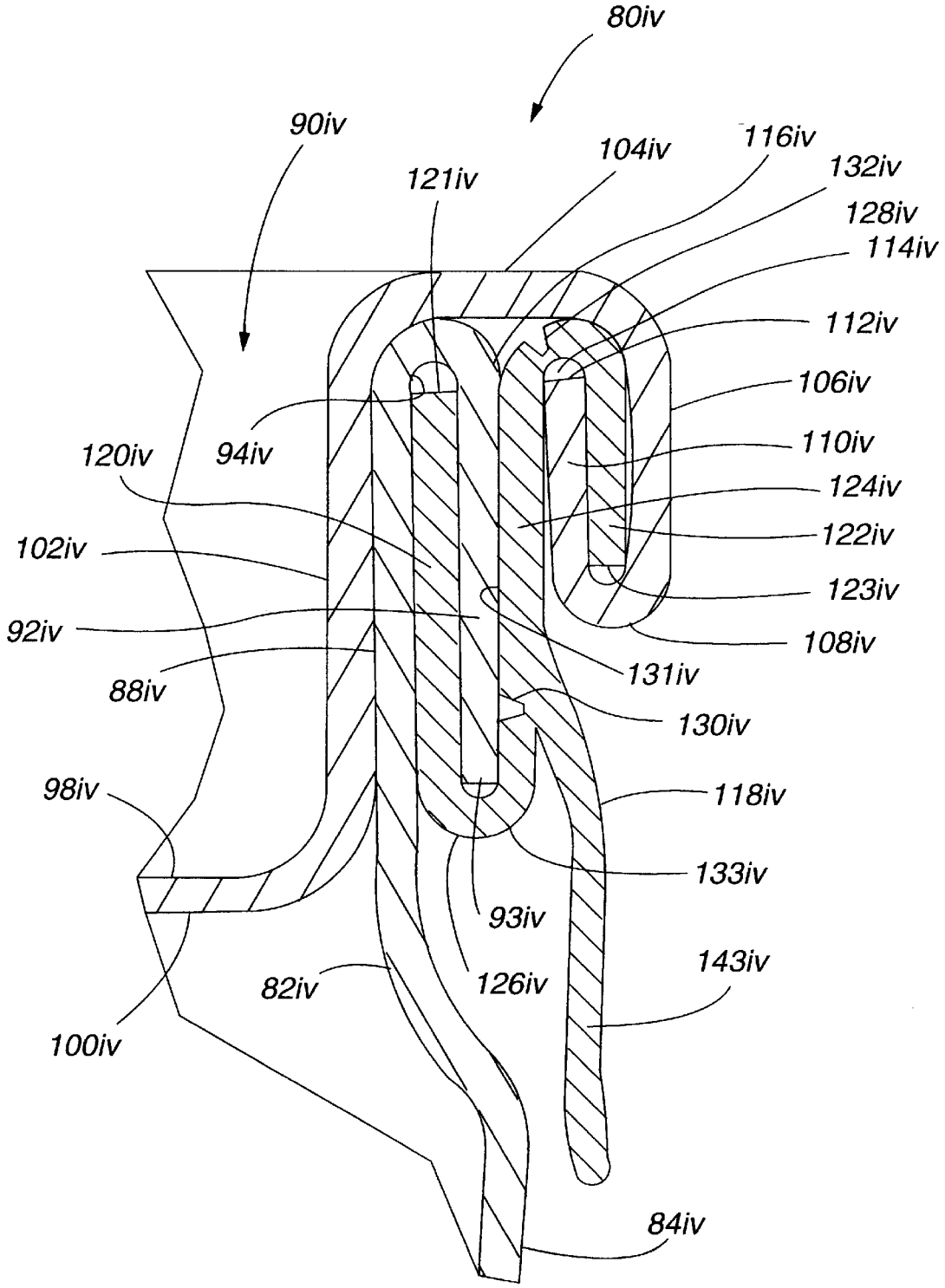
FIG. 8 is cross-sectional view of another embodiment of a container which includes a sealing member and an endpiece.

Another embodiment of a container which utilizes a sealing member or the like is generally depicted in FIG. 8. The container 80$^{iv}$ has the same types of parts as the container 80 of FIG. 1 discussed above, although sizes, relative positionings, and/or orientations of the various identified parts may differ. Therefore, a superscripted "iv" is used to identify the parts in FIG. 8 which generally correspond with those in FIG. 1, but which may differ therefrom in some respect.

There are a number of differences between the container 80 and the container 80$^{iv}$. One difference is the orientation of the upper portion of the container 80$^{iv}$. The first sidewall portion 88$^{iv}$, the container body flange 92$^{iv}$, the endpiece inner wall 102$^{iv}$, the endpiece outer wall 106$^{iv}$, and the endpiece flange 110$^{iv}$ are each disposed substantially parallel with the container body central axis 86$^{iv}$, versus the generally divergent orientation utilized for these parts in the container 80 of FIG. 1. Moreover, the endpiece lower rim 108$^{iv}$ and the free end 93$^{iv}$ of the container body flange 92$^{iv}$ are not at the same general longitudinal position (e.g., along an axis generally parallel with the container body central axis 86$^{iv}$), but are longitudinally offset. Stated another way, the length of the endpiece flange 110$^{iv}$ and the length of the container body flange 92$^{iv}$ are different in the case of the FIG. 8 embodiment, whereas in the FIG. 1 embodiment the length of the endpiece flange 110 is substantially the same as the length of the container body flange 92.

The sealing member 118$^{iv}$ of FIG. 8 also differs from the sealing member 118 presented in FIG. 1, and is generally similar to the sealing member 118$^{ii}$ from the FIG. 6 embodiment. There are also differences between the sealing member 118$^{iii}$ and the sealing member 118$^{ii}$, however. For instance, the first score 130$^{iv}$ and the second score 132$^{iv}$ are each disposed on the same surface of the sealing member 118$^{iv}$, whereas in the case of the sealing member 118$^{ii}$, the first score 130$^{ii}$ and second score 132$^{ii}$ are disposed on opposite surfaces of the sealing member 118$^{ii}$.

The sealing member 118$^{iv}$ of FIG. 8 also differs from the sealing member 118$^{iii}$ of FIG. 7. Specifically, the first score 130$^{iv}$ and the second score 132$^{iv}$ are each disposed on the first surface 131$^{iv}$ in the case of the sealing member 118$^{iv}$ of FIG. 8. In contrast, the first score 130$^{iii}$ and second score 132$^{iii}$ are each disposed on the second surface 133$^{iii}$ in the case of the sealing member 118$^{iii}$ of FIG. 7. Other features discussed above in relation to the embodiments of FIGS. 1, 2, 6, and/or 7 may be utilized in this embodiment as well (e.g., incorporating a snap-lock-like interconnection, a hinged interconnection).

Figure 9:
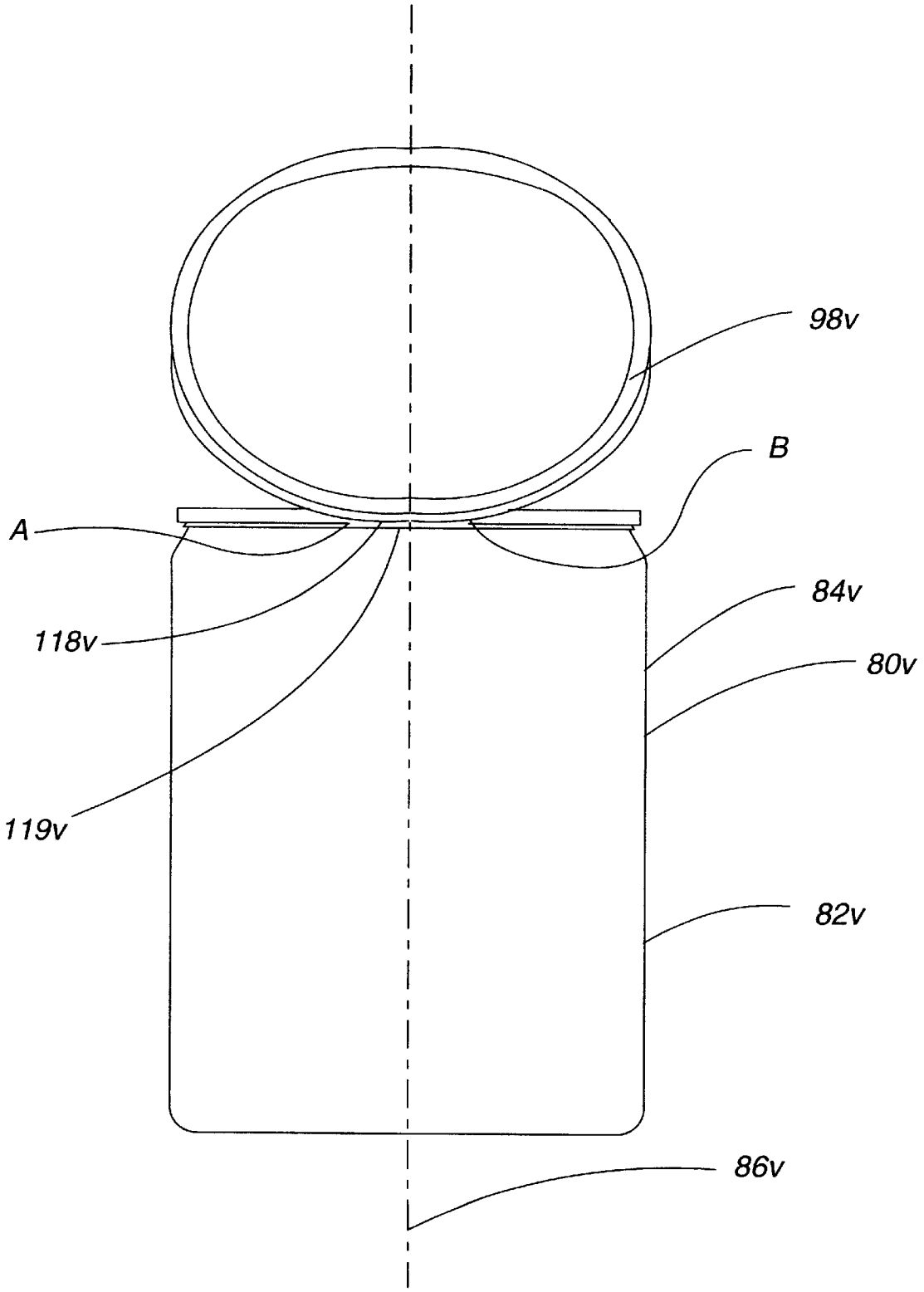
FIG. 9 is a cross-sectional view of another embodiment of a container which includes a sealing member that is configured to allow the endpiece to be hingedly interconnected with the container body, the container being oriented in FIG. 9 to view the hinged connection from the back.
Figure 10B:
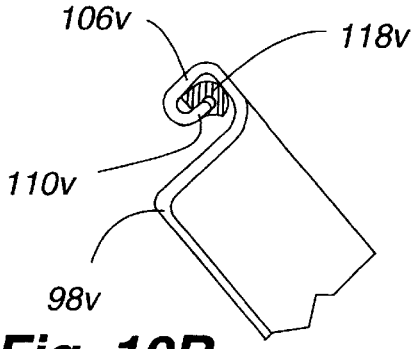
FIG. 10B is an enlarged view of the area enclosed by the reference circle "B" in FIG. 10.
Figure 10C:
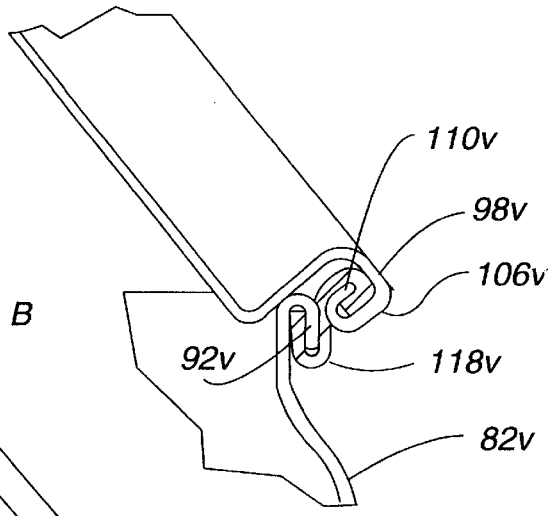
FIG. 10C is an enlarged view of the area enclosed by the reference circle "C" in FIG. 10.
Figure 10A:
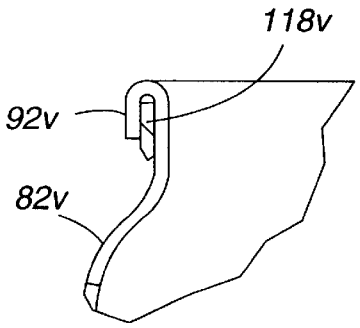
FIG. 10A is an enlarged view of the area enclosed by the reference circle "A" in FIG. 10.
Figure 10:
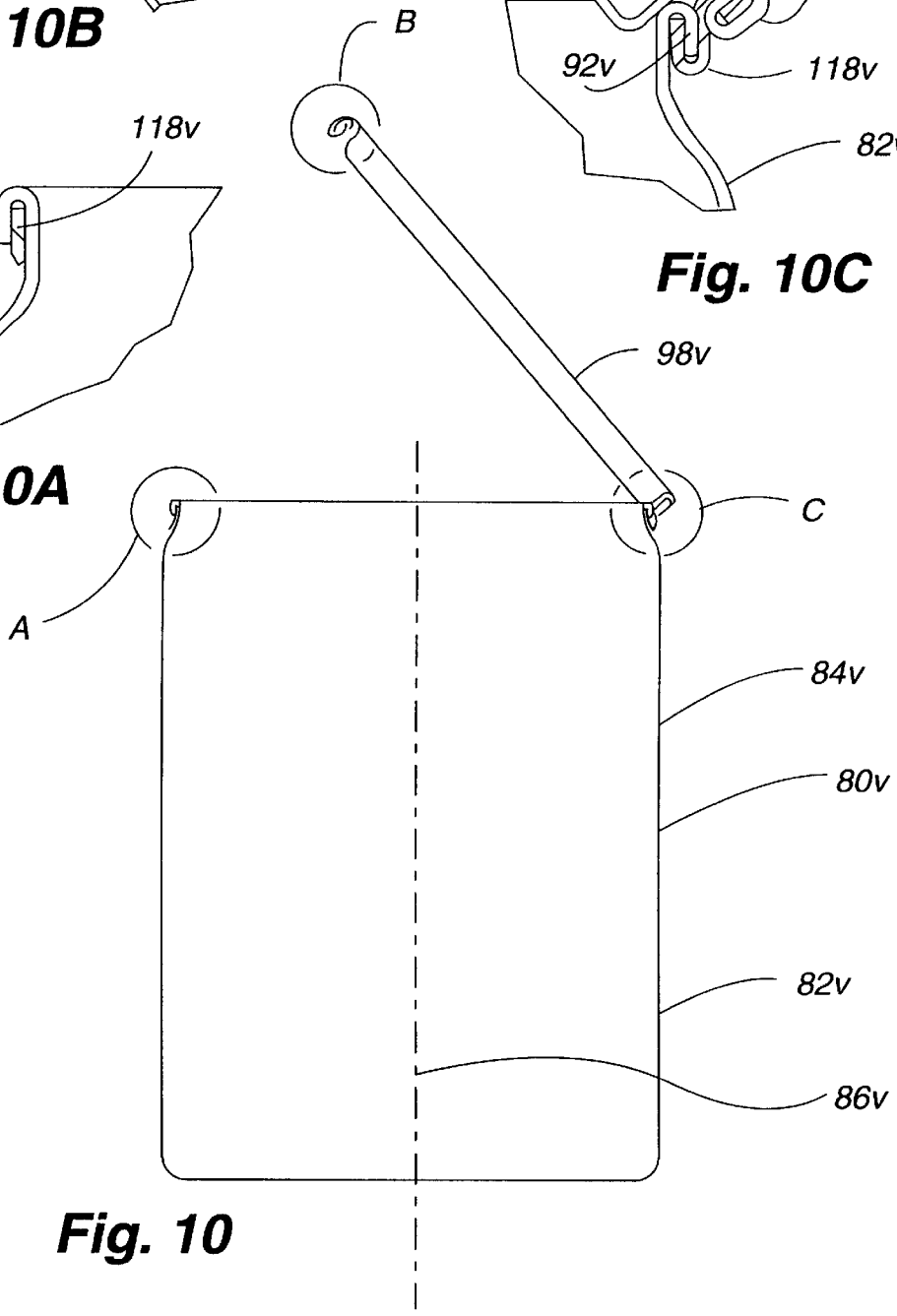
FIG. 10 is a cross-sectional view of the container of FIG. 9, with the container being oriented in FIG. 10 to view the hinged connection from the side.

Another embodiment of a container which utilizes a sealing member or the like is generally depicted in FIGS. 9-10. The container 80$^{v}$ has the same types of parts as the container 80 of FIG. 1 discussed above, although sizes, relative positionings, and/or orientations of the various identified parts may differ. Therefore, a superscripted "v" is used to identify the parts in FIG. 8 which generally correspond with those in FIG. 1, but which may differ therefrom in some respect.

There are a number of differences between the container 80 of FIG. 1 and the container 80$^{v}$ of FIGS. 9-10. The primary difference relates to the type of interconnection between the endpiece 98$^{v}$ and the container body 82$^{v}$. In each of the embodiments of FIGS. 1–8 discussed above, the respective endpiece is totally removable from the respective container body. Contrast this with the container 80$^{v}$ of FIGS. 9-10 where the endpiece 98$^{v}$ is hingedly interconnected with the container body 82$^{v}$, and thereby remains attached to the container body 82$^{v}$ even after and opening of the container 80$^{v}$ to dispense its contents. This hinged interconnection feature could be used on each of the above-discussed embodiments.

Figure 10D:
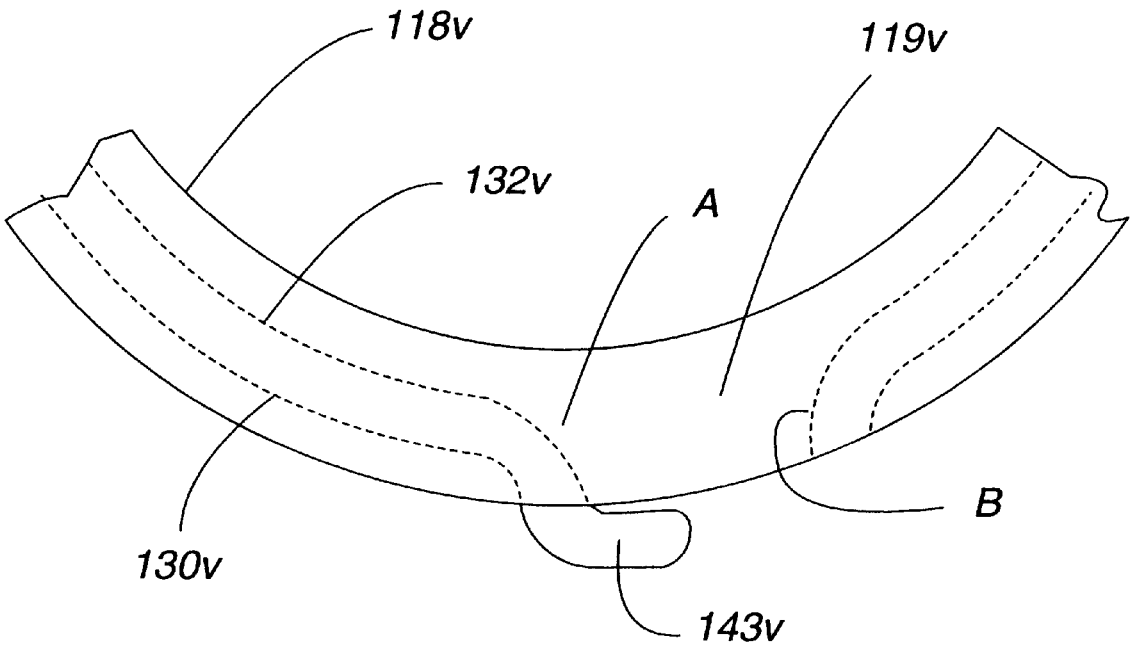
FIG. 10D is a partial perspective view of the sealing member for the container of FIGS. 9 and 10 which illustrates the "unscored" area of the sealing member which defines the hinge.

The hinged interconnection utilized in the FIGS. 9-10 embodiment is affected by a modification of the sealing member. The sealing member 118$^{v}$ has no scores over an unscored, arcuate region 119$^{v}$ which is adjacent the handle 143$^{v}$, which defines the "length" of the hinge, and which is illustrated in more detail in FIG. 10D as an injection molded part which may be "mounted" between the endpiece 98$^{v}$ and container body 82$^{v}$ (i.e., the sealing member 118$^{v}$ is a ring-like structure with no ends). The handle 143$^{v}$ would be disposed at point A in FIG. 9 prior to an initial opening of the container 80$^{v}$. Opening the container 80$^{v}$ would entail advancing the handle 143$^{v}$ about the container 80$^{v}$ to break the scores 130$^{v}$ and 132$^{v}$ in generally the above-described manner. The unscored region 119$^{v}$ would then be encountered at point B in FIG. 9. At this point, the scores 130$^{v}$ and/or 132$^{v}$ could be configured to totally remove the handle 143$^{v}$. As such, the "unscored" region 119 is at the end of the travel of the handle 143.

In each of the above-described embodiments, the container body flange is disposed further from the container central axis than the first sidewall portion. As such, the container body flange is disposed further from the container central axis than the first sidewall portion. Other positional inter-relationships could be utilized. For instance, the container body flange could be disposed radially inwardly of the first sidewall portion. As such, the endpiece flange would be disposed closer to the container central axis than the container body sidewall. Moreover, the endpiece outer wall as described above would actually be disposed radially inwardly of both the endpiece inner wall and the endpiece flange.

Figure 11:
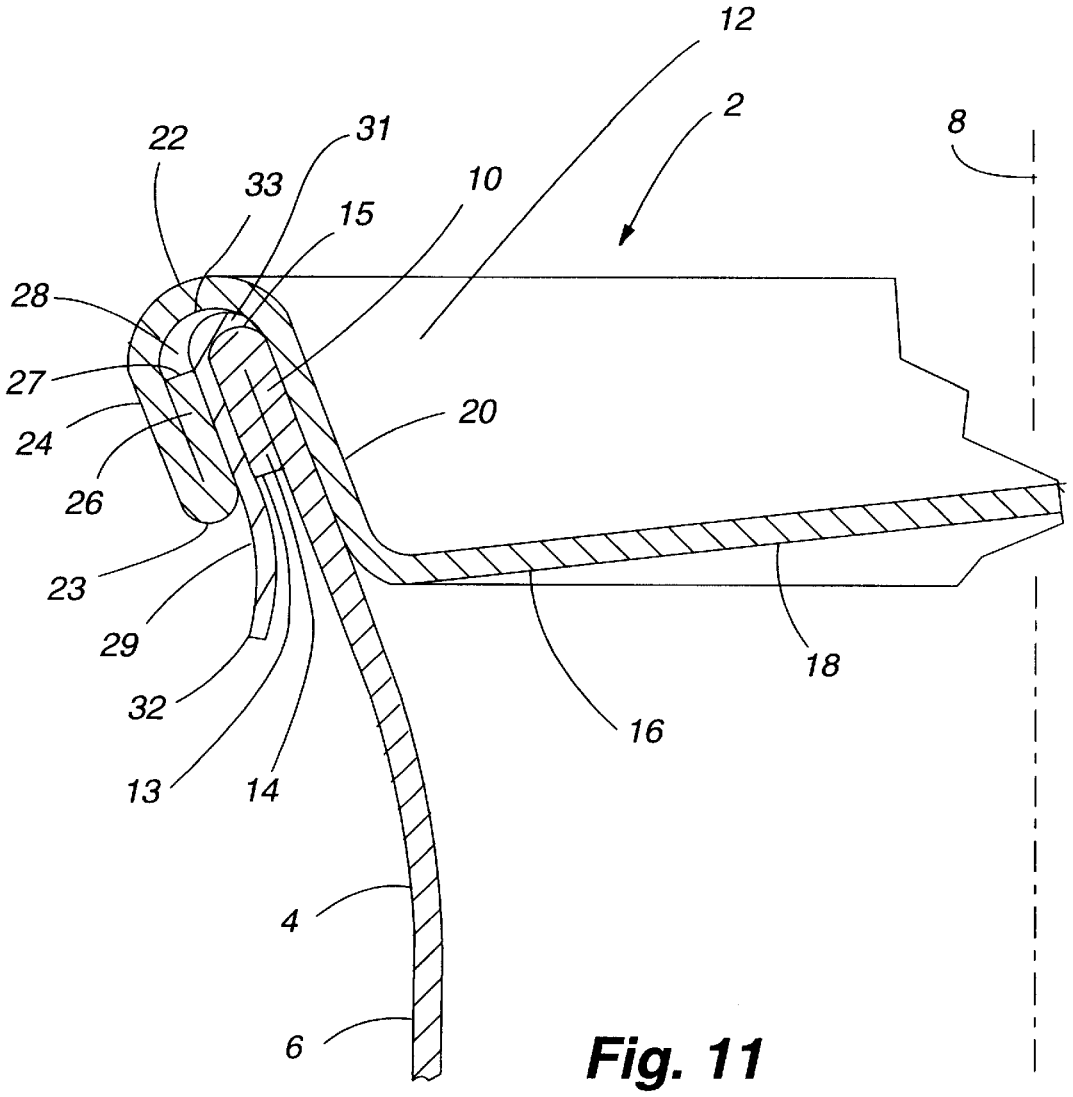
FIG. 11 is cross-sectional view of another embodiment of a container which includes a sealing member and a separate endpiece which is attached thereto.

Another embodiment of a container which utilizes a sealing member or the like is illustrated in FIG. 11. The container 2 includes a container body 4 with an endpiece 16 which is attached thereto in a manner such that it may moved away from the container body 4 to gain access to the contents of the container 2 (e.g., this movement may totally remove the endpiece 16 from the container body 4). The end of the container body 4 opposite that closed by the endpiece 16 may be closed by another endpiece of the same or a different design (i.e., to provide a three-piece container design) or may be integrally formed with the sidewall 6 of the container body 4 (i.e., to provide a two-piece design).

The container body 4 may be formed from a metal or a metal alloy or various other materials, and includes a sidewall 6 which is disposed about a container central axis 8. An upper portion of the sidewall 6 includes a first sidewall portion 10 which diverges away from the container central axis 8. Alternatively, the first sidewall portion 10 could be disposed in substantially parallel relation with the container central axis 8 (not shown). The upper extreme of the sidewall 6 is defined by a container body rim 15 which in turn defines a first open end 12 for the container body 4 which is closed by the endpiece 16 in a manner discussed below. The container body 4 further includes a container body flange 14 which is interconnected with the first sidewall portion 10 by the container body rim 15. The container body flange 14 is disposed radially outwardly of the first sidewall portion 10 and in substantial flush engagement therewith.

The endpiece 16 is formed from a metal or a metal alloy or various other materials, is a separate piece from the container body 4 (e.g., the container body 4 and endpiece 16 are not integrally formed), and is appropriately attached thereto (e.g., via a seaming operation). The endpiece 16 may be totally removable from the container body 4 to gain access to the contents of the container 2 as noted above. The endpiece 16 includes a generally domed central panel 18 which in the illustrated embodiment has no aperture(s) therein and no push-down tab(s) or the like. The central panel 18 extends upwardly, or away from the opposite end of the container body 4, or in the direction in which the first open end 12 of the container body 4 projects, such that its upper surface (i.e., the "public" side of the endpiece 16) is generally convexly-shaped. The generally domed central panel 18 may be utilized to vent the container 2 after a sealing member 29 disposed between the endpiece 16 and container body 4 is removed in a manner discussed in more detail below. A substantially flat central panel which is disposed generally perpendicularly to the container center axis 8 could be utilized as well (not shown). In this case or even in the illustrated configuration, it may be desirable to include at least one push-down tab or the like on the central panel 18 to assist in venting of the interior of the container 2 prior to movement of the endpiece 16 away from the container body 4 to gain access to the contents of the container 2.

An annular endpiece inner wall 20 extends upwardly from the central panel 18 and away from the container central axis 8 (this wall 20 alternatively may be disposed generally parallel with the container center axis), is disposed inwardly of the first sidewall portion 10 relative to the container central axis 8, and is substantially flushly engaged with the first sidewall portion 10 (e.g., the endpiece inner wall 20 is disposed in substantial parallel relation with the first sidewall portion 10). In one embodiment, the endpiece inner wall 20 and first sidewall portion 10 are substantially flushly engaged over a linear distance of at least about 0.020 inch which may be of assistance when reclosing the container body 4 with the endpiece 16 thereto.

The endpiece 16 further includes an annular endpiece outer wall 24 which is disposed radially outwardly from the endpiece inner wall 20 (e.g., the distance from the container central axis 8) and which is interconnected therewith by an annular upper crown or rim 22. In one embodiment, the endpiece outer wall 24 is disposed in substantial parallel relation with both the endpiece inner wall 20 and the first sidewall portion 10 of the container body 4. An endpiece flange 26 is interconnected with the endpiece outer wall 24 by an annular lower rim 23. The endpiece flange 26 is disposed in substantial parallel relation with the endpiece outer wall 24 and has a free end 27 which projects generally in the direction of the first open end 12 of the container body 4. A space 28 exists between the free end 27 of the endpiece flange 26 and the interior surface of the upper endpiece crown 22, although this space 28 may be minimized and/or totally alleviate in other embodiments (not shown). The endpiece outer wall 24 and the endpiece flange 26 are disposed in substantial abutting engagement.

Figure 11A:
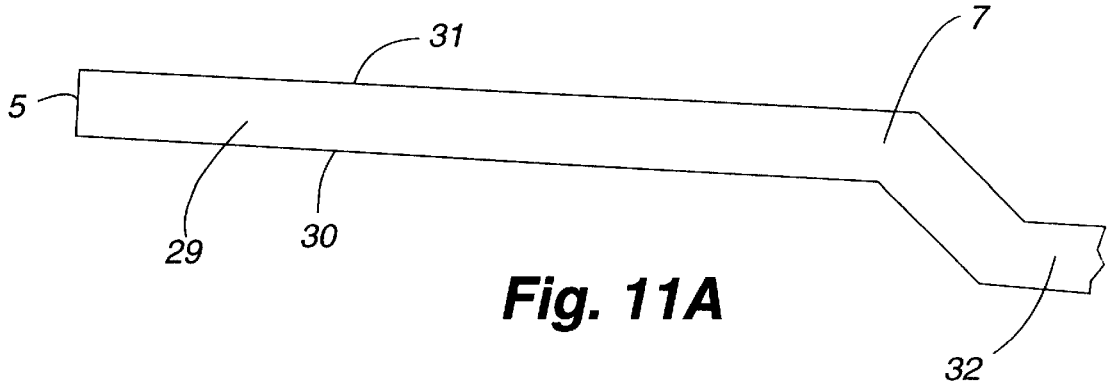
FIG. 11A is an enlarged plan view of the sealing member used by the container of FIG. 11.

A sealing member 29 (FIGS. 11 and 11A) is disposed between the endpiece flange 26 and the container body flange 14 to provide at least one seal therebetween, and includes a handle 32 which is accessible by a consumer on an exterior of the container 2. The sealing member 29 includes a first longitudinal edge 30 which is disposed proximate the free end 13 of the container body flange 14, and a second longitudinal edge 31 which is disposed between the upper endpiece crown 22 and the container body rim 15. In one embodiment, the sealing member 29 is formed from a resinous material (e.g., polypropylene thermoset plastic) to suitably provide the desired sealing function. An appropriate sealing compound 33 may also be deposited on the interior surface of the upper endpiece crown 22 to enhance the seal between the endpiece 16 and the container body 4.

Figure 11B:
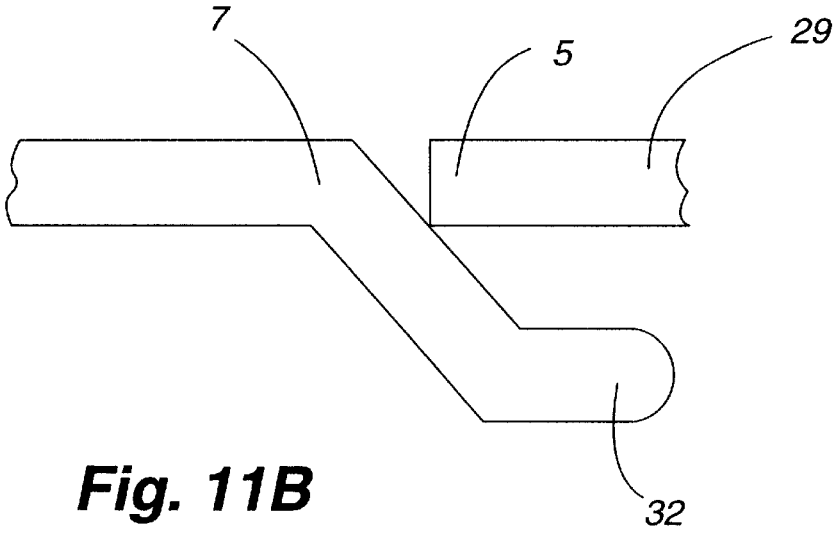
FIGS. 11B–D are views which illustrate ways in which the two ends of the sealing strip of FIG. 11A may be integrated on the container of FIG. 11.
Figure 11C:
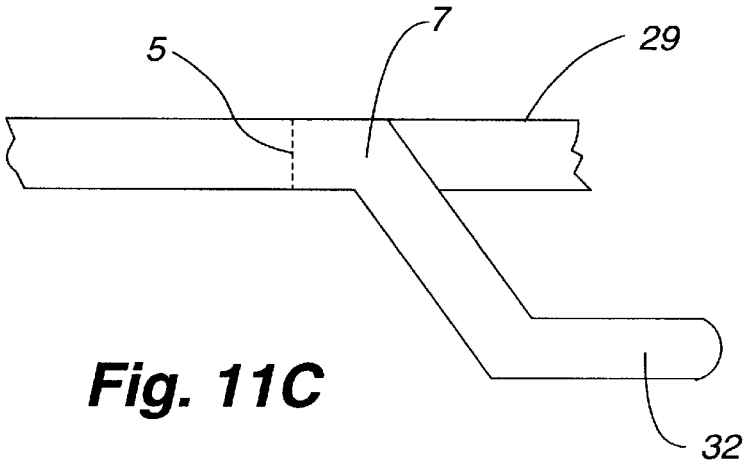
Figure 11D:
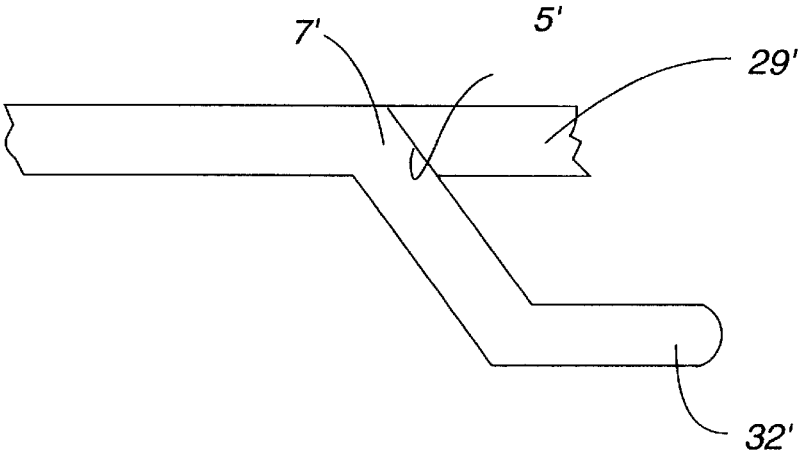

The sealing member 29 is disposed at least substantially annularly about the container central axis 8 to preferably provide an annular seal between the container body 4 and the endpiece 16. In one embodiment, the length of the sealing member 29 is such that the end 5 of the sealing member 29 is disposed adjacent to and/or butts up against the portion 7 of the sealing member 29 which is where the handle 32 descends therefrom (e.g., FIGS. 11B and 11D). In another embodiment, the end 5 of the sealing member 29 is disposed in overlapping relation with the portion 7 of the sealing member 29 (e.g., FIG. 11C). In yet another embodiment, the two "ends" of the sealing member 29 are secured together when installed on the container 2, such as by use of appropriate adhesives or other types of sealing operation (e.g., heat sealing), and most typically when the two "ends" are disposed in overlapping relation such as in the case of the embodiment of FIG. 11C.

The endpiece 16 is moved away from the container body 4 in the illustrated embodiment to gain access to the contents of the container 2 (e.g., by totally removing the endpiece 16 from the container body 4). The consumer grabs the handle 32 of the sealing member 29 and pulls the sealing member 29 about the container central axis 8 to pull the entire sealing member 29 out from in between the container body flange 14 and the endpiece flange 26. This removes the seal previously provided by the sealing member 29. The consumer may thereafter push down on the generally dome-shaped central panel 18 of the endpiece 16 (i.e., apply a force in the direction of the opposite end of the container 2) to vent the interior of the container body 4 if desired/required such that the endpiece 16 may then be pulled away from the container body 4 to provide access through its first open end 12. This action is particularly desirable when the interior of the container 2 is under a vacuum prior to "removal" of the seal between the container body 4 and endpiece 16 provided by the sealing member 29, and further when additional seals exist between the endpiece 16 and container body 4 (e.g., by one or more mechanical purchases between the container body 4 and the endpiece 16). Pushing the central panel 18 in the above-noted manner may relieve any further seals between the endpiece 16 and container body 4, such as by providing a gap between the above-noted mechanical purchases. Notably, after the endpiece 16 has been appropriately moved away from the container body 4 to gain access to the contents of the container 2, there are no edges or the like on the upper portion of the sidewall 6 which will impede the flow out of the container body 4 based upon the type of interconnection between the endpiece 16 and the container body 4.

Figure 11E:
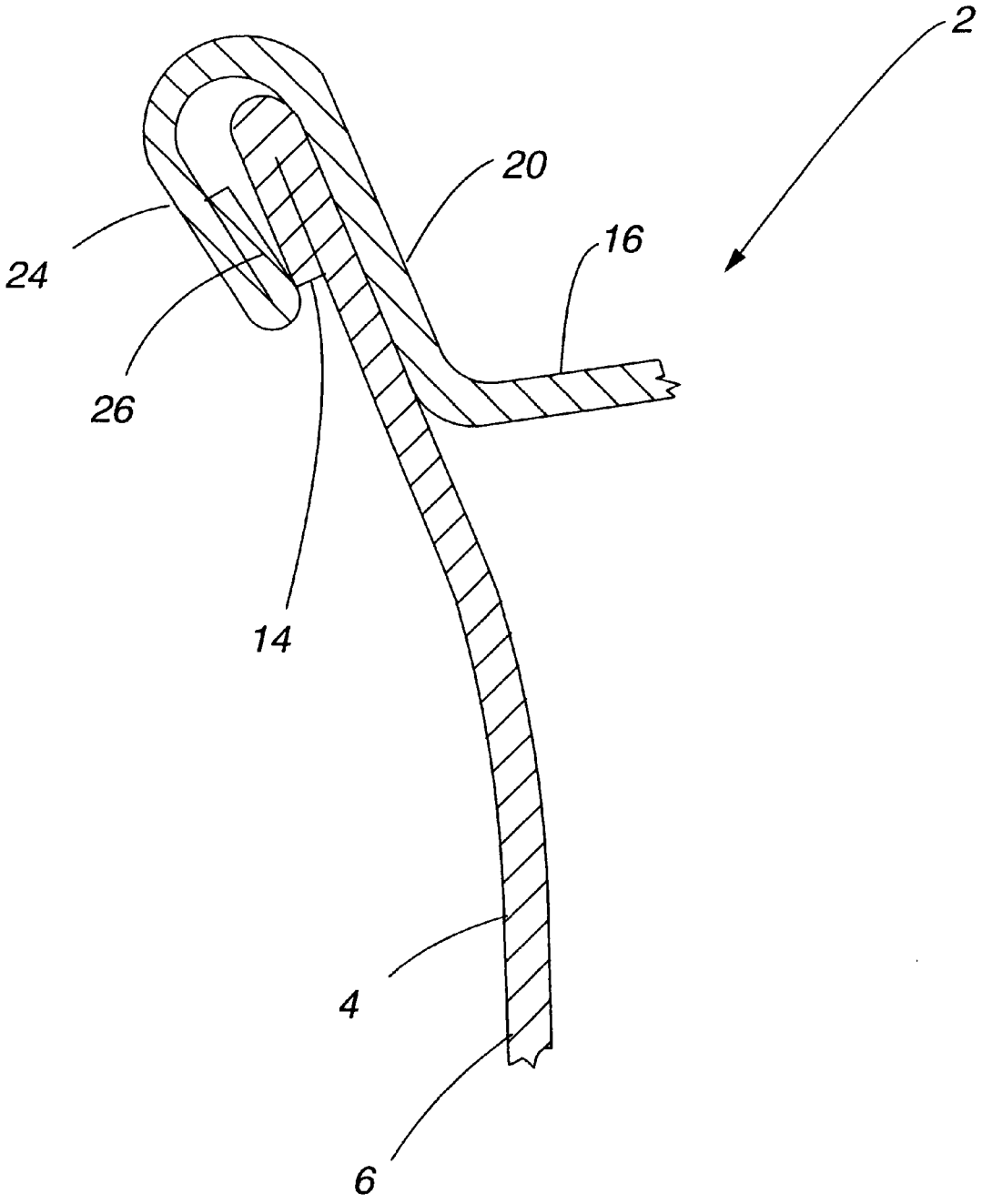
FIG. 11E is a cross-sectional view of the container of FIG. 11 after the sealing member has been removed therefrom and which illustrates a "reclosability" feature thereof.

The container 2 is reclosable after the endpiece 16 has been totally removed from the container body 4 in that the endpiece 16 may be reattached to the container body 4 by being disposed within the first open end 12 of the container body 4. The engagement between the endpiece inner wall 20 and the first sidewall portion 10 provides one feature which may facilitate reclosure of the container body 4 with the endpiece 16. Yet another feature which may facilitate reclosure of the container body 4 by the endpiece 16 is the fact that the endpiece flange 26 is resiliently biased to engage the container body flange 14 after the sealing member 29 has been removed in the above-noted manner. This is shown in FIG. 11E where there is a mechanical purchase of sorts between the endpiece flange 26 and the container body flange 14 after the sealing member 29 has been removed and due to the resilient bias of the endpiece flange 26 toward the container body flange 14. Reclosure may be further facilitated by disposing the endpiece inner wall 20 and the first sidewall portion 10 substantially parallel with the axis 8, and incorporating a press-fit and/or a snap-lock interconnection therebetween.

Figure 12:
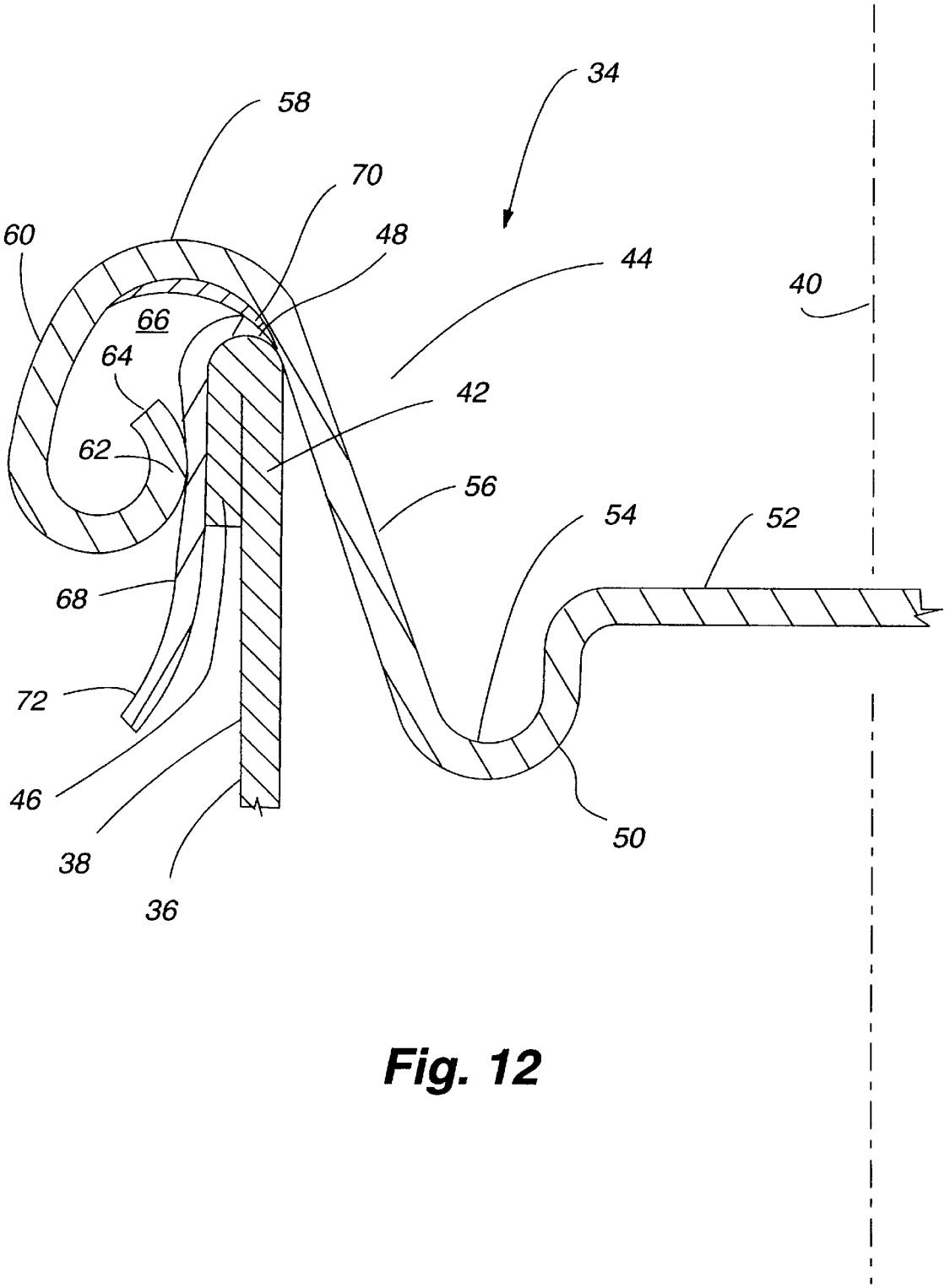
FIG. 12 is cross-sectional view of another embodiment of a container which includes a sealing member and a separate endpiece which is attached thereto.

Another embodiment of a container with a seal member or the like is illustrated in FIG. 12. The container 34 of FIG. 12 includes a container body 36 with an endpiece 50 which is appropriately secured thereto to close the first open end 44 of the container body 36 (e.g., totally removable therefrom) The end of the container body 34 opposite that sealed by the endpiece 50 may be closed by another endpiece of the same or a different design (i.e., to provide a three-piece container design) or may be integrally formed with the sidewall 38 of the container body 36 (i.e., to provide a two-piece container design).

The container body 36 may be formed from a metal or a metal alloy or various other materials, and includes a sidewall 38 which is disposed about a container central axis 40. An upper portion of the sidewall 38 is defined by a first sidewall portion 42 which is substantially parallel with the container central axis 40 and which is interconnected with a container body flange 46 by a container body rim 48. The container body rim 48 defines the upper extreme of sidewall 36 which in turn defines a first open end 44 for the container body 36 which is closed/reclosed by the endpiece 50 in a manner discussed in more detail below.

The endpiece 50 is formed from a metal or a metal alloy or various other materials, is a separate piece from the container body (i.e., the endpiece 50 and container body 36 need not be integrally formed), is appropriately attached thereto (e.g., via a seaming operation), and is totally removable from the container body 36. The endpiece 50 includes a generally flat central panel 52 which has no apertures therein and no push-down tab(s) or the like. In another embodiment, at least one aperture and/or push-down tab or the like could be incorporated on the central panel 52. Moreover, in another embodiment the central panel 52 is generally dome-shaped as in the case of the FIG. 11 embodiment discussed above (with or without one or more push-down tabs or the like).

A generally U-shaped annular groove 54 is disposed about the central panel 52. An annular endpiece inner wall 56 extends upwardly from the annular groove 54 and away from the container central axis 40, is disposed radially inwardly of the first sidewall portion 42 relative to the container central axis 40, and engages the first sidewall portion 42 at substantially its juncture with the container body upper rim 48. In another embodiment, the endpiece inner wall 56 is disposed in substantially parallel relation with the container central axis 40 and flushly engages the first sidewall portion 42 in the manner discussed above in relation to the FIG. 11 embodiment.

The endpiece 50 further includes an annular endpiece outer wall 60 which is disposed radially outwardly of the endpiece inner wall 56 and which is interconnected therewith by an annular upper crown or rim 58 which is substantially defined by a radius. The endpiece outer wall 60 extends downwardly from the upper crown 58 generally away from the container central axis 40 for interconnection with a generally C-shaped endpiece flange 62. The convex portion of the endpiece flange 62 projects toward the container body flange 46.

A sealing member 68 is disposed between the endpiece flange 62 and the container body flange 46, and includes a handle 72 which is accessible by a consumer on an exterior of the container 34. The sealing member 68 is disposed at least substantially annularly about the container central axis 40 to preferably provide an annular seal between the container body 34 and the endpiece 50, and thereby may utilize the various "lengths" discussed above in relation to the FIG. 11 embodiment. The endpiece flange 62 compressively engages the sealing member 68 against the container body flange 46 to define an enclosed space 66. The sealing member 68 also extends up into the space 66 and has its longitudinal edge 70 disposed between the upper endpiece crown 58 and the container body rim 48. In one embodiment, the sealing member 29 is formed from a resinous material (e.g., polypropylene thermoset plastic) to suitably provide the desired sealing function. An appropriate sealing compound 74 may also be deposited on the interior surface of the upper crown 58 of the endpiece 50 to enhance the seal between the endpiece 50 and the container body 36.

Figure 12A:
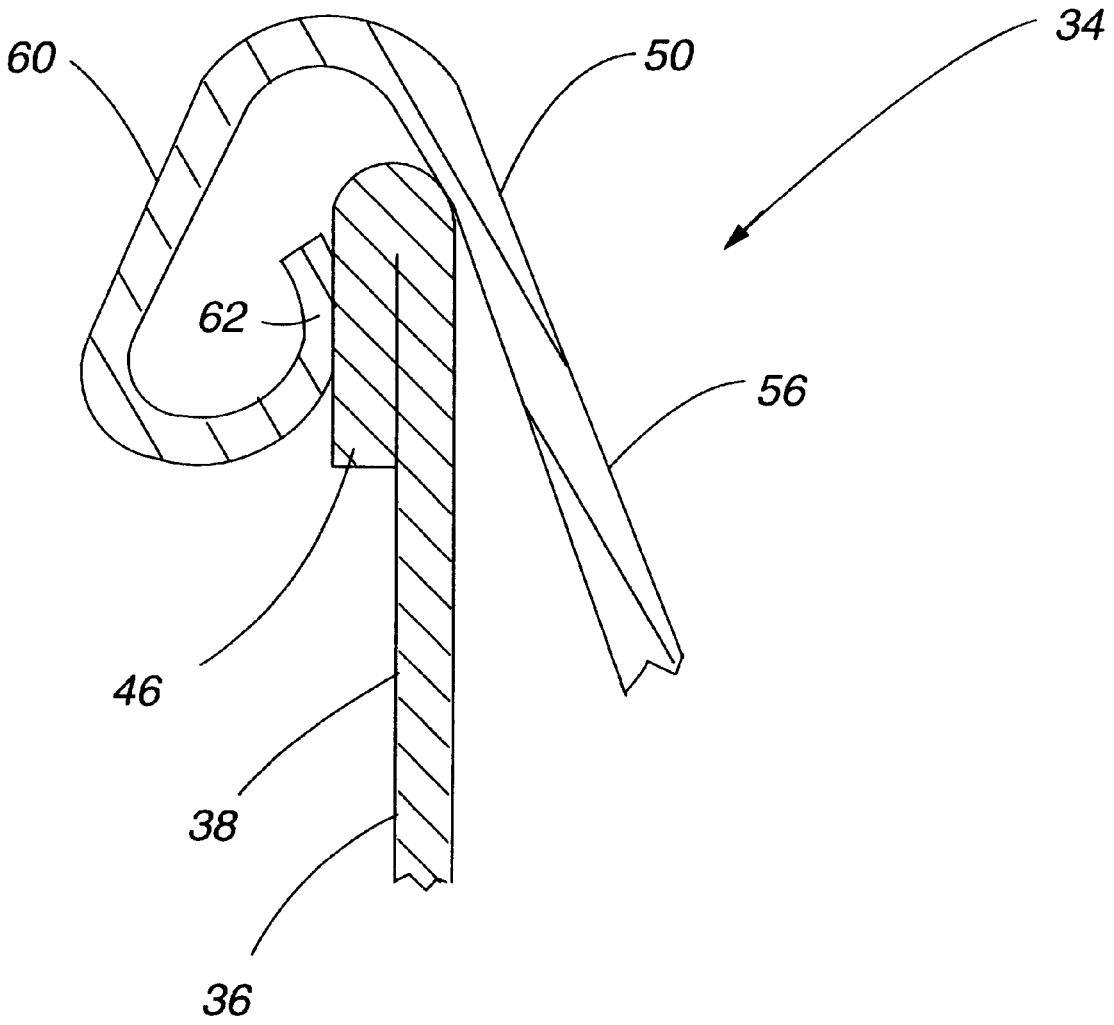
FIG. 12A is a cross-sectional view of the container of FIG. 12 after the sealing member has been removed therefrom and which illustrates a "reclosability" feature thereof.

The endpiece 50 is totally removed from the container body 36 to gain access to the contents of the container 34. The consumer grabs the handle 72 of the sealing member 68 and pulls the sealing member 68 about the container central axis 40 and pulls the sealing member 68 out from in between the container body flange 46 and the endpiece flange 62. There are no edges or the like on the upper portion of the sidewall 38 which could impede the flow out of the container body 36 based upon the type of interconnection utilized between the endpiece 50 and the container body 36. The container 34 is reclosable in that the endpiece 50 may be reattached to the container body 36 by being disposed within the first open end 44. The interfacing relation between the inner endpiece wall 56 and the first sidewall portion 42 may facilitate reclosure of the container body 36 with the endpiece 50. Yet another feature which may facilitate reclosure of the container body 36 with the endpiece 50 is the fact that the endpiece flange 62 is resiliently biased to engage the container body flange 46 after the sealing member 68 has been removed in the above-noted manner in relation to the FIG. 11 embodiment. This is shown in FIG. 12A where there is a mechanical purchase between the endpiece flange 62 and the container body flange 46 due to the bias of the endpiece flange 62.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A container, comprising:

a container body comprising a sidewall, having inner and outer surfaces, disposed about a central, longitudinal axis and a first rim region of said container body folded radially out and down to form a container body flange positioned radially outward from and in contact with an adjacent portion of said sidewall, said flange having a radially outer surface which is substantially continuous with said inner sidewall surface, wherein said container body flange is disposed on a first open end of said container body;

an endpiece, having inner and outer surfaces closing said first open end of said container body and comprising a first endpiece wall radially spaced from said container body flange relative to said axis, said endpiece further comprising a rim region of said endpiece folded radially in and up to form an endpiece flange having a radially inner surface which is substantially continuous with said outer endpiece surface wherein said endpiece flange is radially spaced from said container body flange by a space relative to said axis;

a sealing member disposed in at least a portion of said space, compressed between said container body flange outer surface and said endpiece flange inner surface, said sealing member comprising a handle which is accessible exteriorly of said container.

2. A container comprising:

a container body comprising a sidewall disposed about a central, longitudinal axis and a container body flange radially spaced from a first sidewall portion of said sidewall by a first space relative to said axis, wherein said container body flange is disposed on a first open end of said container body;

an endpiece closing said first open end of said container body and comprising a first endpiece wall radially spaced from said container body flange relative to said axis, said endpiece further comprising an endpiece flange separated from said first endpiece wall by a second space, interconnected with said first endpiece wall, and disposed between said first endpiece wall and said endpiece flange, wherein said endpiece flange is radially spaced from said container body flange by a third space relative to said axis;

a sealing member disposed in at least a portion of said first, second, and third spaces, said sealing member comprising a handle which is accessible exteriorly of said container;

wherein said sealing member comprises a first sealing member portion disposed in said first space between said container body flange and said first sidewall portion of said container body, a second sealing member portion disposed in said second space between said first endpiece wall and said endpiece flange, a third sealing member portion disposed in said third space between said endpiece flange and said container body flange, a first sealing member interconnecting portion which interconnects said first and third sealing member portions, and a second sealing member interconnecting portion which interconnects said second and third sealing member portions; and a score in each of said first and second sealing member interconnecting portions.

3. A container comprising:

a container body comprising a sidewall disposed about a central, longitudinal axis and a container body flange radially spaced from a first sidewall portion of said sidewall by a first space relative to said axis, wherein said container body flange is disposed on a first open end of said container body;

an endpiece closing said first open end of said container body and comprising a first endpiece wall radially spaced from said container body flange relative to said axis, said endpiece further comprising an endpiece flange separated from said first endpiece wall by a second space, interconnected with said first endpiece wall, and disposed between said first endpiece wall and said endpiece flange, wherein said endpicce flange is radially spaced from said container body flange by a third space relative to said axis;

a sealing member disposed in at least a portion of said first, second, and third spaces, said sealing member comprising a handle which is accessible exteriorly of said container;

at least one score in said sealing member and a head which interfaces with an interior surface of said sealing member and a score rupturing member interconnected with said head and which extends through said at least one score to be accessible on an exterior surface of said container.

4. A container comprising:

a container body comprising a sidewall disposed about a central, longitudinal axis and a container body flange radially spaced from a first sidewall portion of said sidewall by a first space relative to said axis, wherein said container body flange is disposed on a first open end of said container body;

an endpiece closing said first open end of said container body and comprising a first endpiece wall radially spaced from said container body flange relative to said axis, said endpiece further comprising an endpiece flange separated from said first endpiece wall by a second space, interconnected with said first endpiece wall, and disposed between said first endpiece wall and said endpiece flange, wherein said endpiece flange is radially spaced from said container body flange by a third space relative to said axis;

a sealing member disposed in at least a portion of said first, second, and third spaces, said sealing member comprising a handle which is accessible exteriorly of said container;

wherein said sealing member includes at least one score, said score having first and second ends, wherein a space between said first and second ends provides a hinge for hingedly interconnecting said endpiece and said container body.

5. A container comprising:

a container body comprising a sidewall disposed about a central, longitudinal axis and a container body flange radially spaced from a first sidewall portion of said sidewall by a first space relative to said axis, wherein said container body flange is disposed on a first open end of said container body;

an endpiece closing said first open end of said container body and comprising a first endpiece wall radially spaced from said container body flange relative to said axis, said endpiece further comprising an endpiece flange separated from said first endpiece wall by a second space, interconnected with said first endpiece wall, and disposed between said first endpiece wall and said endpiece flange, wherein said endpiece flange is radially spaced from said container body flange by a third space relative to said axis;

a sealing member disposed in at least a portion of said first, second, and third spaces, said sealing member comprising a handle which is accessible exteriorly of said container;

wherein said sealing member has an arcuate extent about said axis and comprises a first score and a second score each having an arcuate extent about said axis.

6. A container, as claimed in claim 5, wherein:

said container body further comprises a first container body interconnecting portion between said first sidewall portion and said container body flange, wherein said first sidewall portion, said first container body interconnecting portion, and said container body flange collectively define a substantially U-shaped structure with said container body flange having a free end which is generally directed away from said first open end.

7. A container, as claimed in claim 5, wherein:

an uppermost portion of said first sidewall portion is free from any edges which could impede a flow from said container body after said endpiece is moved away from said container body after a seal provided by said sealing member is broken.

8. A container, as claimed in claim 5, wherein:

said first sidewall portion, said container body flange, said first endpiece wall, said endpiece flange, said first space, said second space, and said third space are each annular.

9. A container, as claimed in claim 5, wherein:

said sealing member comprises first and second surfaces, said first and second scores each being disposed on only one of said first and second surfaces.

10. A container, as claimed in claim 5, wherein:

said sealing member comprises first and second surfaces, said first score being on said first surface and said second score being on said second surface.

11. A container, as claimed in claim 5, further comprising:

means for rupturing at least one of said first score and said second scores, said means for rupturing comprising said handle.

12. A container, as claimed in claim 5, further comprising:

a score rupture assembly associated with at least one of said first score and said second scores, said score rupture assembly comprising said handle.

13. A container, as claimed in claim 5, wherein:

said endpiece further comprises a center panel and a second endpiece wall disposed about said center panel and disposed inwardly of said first sidewall portion of said container body relative to said axis.

14. A container, as claimed in claim 13, wherein:

said first endpiece wall and said endpiece flange are each disposed radially outwardly of said container body flange and thereby said second endpiece wall.

15. A container, as claimed in claim 13, wherein:

said first sidewall portion and said second endpiece wall are substantially flushly engaged.

16. A container, as claimed in claim 5, wherein:

said sealing member comprises a first sealing member portion disposed in said first space between said container body flange and said first sidewall portion of said container body, a second sealing member portion disposed in said second space between said first endpiece wall and said endpiece flange, a third sealing member portion disposed in said third space between said endpiece flange and said container body flange, a first sealing member interconnecting portion which interconnects said first and third sealing member portions, and a second sealing member interconnecting portion which interconnects said second and third sealing member portions.

17. A container, as claimed in claim 16, wherein:

said container body flange comprises a free end which is directed generally away from said first open end of said container body and wherein said first sealing member interconnecting portion is disposed below said free end of said container body flange.

18. A container, as claimed in claim 16, wherein:

said first endpiece wall and said endpiece flange are interconnected by a first endpiece interconnecting portion, wherein said endpiece flange comprises a free end which is directed generally in a direction of said first open end of said container body, and wherein said second sealing member interconnecting portion is disposed above said free end of said endpiece flange.

19. A container, as claimed in claim 16, further comprising:

a score in at least one of said first and second sealing member interconnecting portions.

* * * * *